US012110164B2

(12) United States Patent
Shotwell et al.

(10) Patent No.: US 12,110,164 B2
(45) Date of Patent: Oct. 8, 2024

(54) PACKAGE WITH SUPPLEMENTAL SEAL

(71) Applicant: AMCOR FLEXIBLES NORTH AMERICA, INC., Neenah, WI (US)

(72) Inventors: Rebecca J. Shotwell, Neenah, WI (US); Abigail H. Koep, Parkers Prairie, WI (US); Shiming Zhuang, Neenah, WI (US); Teressa A. Baumann, Neenah, WI (US); Nina L. Marchione, New Baltimore, MI (US); Jay D. Hodson, Hortonville, WI (US)

(73) Assignee: AMCOR FLEXIBLES NORTH AMERICA, INC., Neenah, WI (US)

( * ) Notice: Subject to any disclaimer, the term of this patent is extended or adjusted under 35 U.S.C. 154(b) by 168 days.

(21) Appl. No.: 17/779,444

(22) PCT Filed: Dec. 12, 2019

(86) PCT No.: PCT/US2019/066196
§ 371 (c)(1),
(2) Date: May 24, 2022

(87) PCT Pub. No.: WO2021/118592
PCT Pub. Date: Jun. 17, 2021

(65) Prior Publication Data

US 2022/0411158 A1 Dec. 29, 2022

(51) Int. Cl.
*B65D 75/58* (2006.01)
*B65D 81/32* (2006.01)

(52) U.S. Cl.
CPC ..... *B65D 75/5883* (2013.01); *B65D 81/3266* (2013.01); *B65D 2575/54* (2013.01)

(58) Field of Classification Search
CPC ..... B65D 75/5883; B65D 81/3266; B65D 2575/54
USPC ..... 383/78
See application file for complete search history.

(56) References Cited

U.S. PATENT DOCUMENTS

| | | | |
|---|---|---|---|
| 2004/0118710 | A1 | 9/2004 | Koren et al. |
| 2005/0087456 | A1 | 4/2005 | Oka et al. |
| 2006/0196784 | A1 | 9/2006 | Murray |
| 2007/0217717 | A1 | 9/2007 | Murray |
| 2009/0238495 | A1 | 9/2009 | Anderson |
| 2010/0016825 | A1 | 1/2010 | Thomas et al. |
| 2011/0103714 | A1 | 5/2011 | Steele et al. |

(Continued)

FOREIGN PATENT DOCUMENTS

| | | | |
|---|---|---|---|
| EP | 3536627 | A1 | 9/2019 |
| JP | 147353 | A | 6/1998 |

(Continued)

OTHER PUBLICATIONS

Feb. 5, 2024 Machine translation of JP-2012206780-A.*
PCT International Search Report, International Application No. PCT/US2019/066196, issued Mar. 3, 2020, 3 pages.

*Primary Examiner* — Jes F Pascua

(57) ABSTRACT

A package includes a first adjacent edge, a second adjacent edge, and a fitment seal including a fitment. The fitment seal is inclined at a fitment seal angle relative to the first adjacent seal, and connects to the first adjacent seal and the second adjacent seal. The package further includes at least one supplemental seal extending towards the first adjacent seal. The at least one supplemental seal is inclined at an angle from 90° to 180° relative to the first adjacent seal.

8 Claims, 14 Drawing Sheets

(56) References Cited

U.S. PATENT DOCUMENTS

| | | | | |
|---|---|---|---|---|
| 2015/0251846 | A1 | 9/2015 | Rasmussen | |
| 2016/0052705 | A1 | 2/2016 | Murray | |
| 2016/0152392 | A1 | 6/2016 | Murray | |
| 2016/0280439 | A1 | 9/2016 | Murray | |
| 2019/0256269 | A1* | 8/2019 | Miura | B65D 75/5883 |

FOREIGN PATENT DOCUMENTS

| | | | | | |
|---|---|---|---|---|---|
| JP | 2012206780 | A | * | 10/2012 | |
| JP | 2017065747 | A | * | 4/2017 | |
| WO | 2011043149 | A1 | | 4/2011 | |
| WO | WO-2018083980 | A1 | * | 5/2018 | B65D 31/00 |

* cited by examiner

PACKAGE WITH SUPPLEMENTAL SEAL

TECHNICAL FIELD

The present application relates generally to packages, and in particular to packages with supplemental seals.

BACKGROUND

Various types of disposable, portable containers are known in the art for containing products. A flexible pouch is an example of such containers. Flexible pouches can be provided with fitments for dispensing the contained product. Pouches (typically one quart (0.94 liters) in volume or more) are provided with fitments for ease of pouring the contents from the pouch.

Large volume pouches have become a viable packaging option in e-commerce. The flexible pouches afford lighter weight containers than rigid counterparts and thus contribute to lower shipping costs. For example, large volumes of laundry detergent, paint, beverages, etc. that are shipped in flexible pouches weigh less than if they were packaged in rigid (plastic or metal) containers. Further, due to the flexibility of the pouches, more efficient secondary packaging space utilization is recognized over their rigid counterparts.

Large volume pouches are not without drawbacks, however. Pouches are susceptible to tear or failure during shipping or other forms of handling. For example, fitments placed along the top seal of the pouch are prone to rubbing the interior of the secondary package that leads to pouch failure and leakage near the fitment due to the vibrational stresses placed upon the fitment and pouch. In use, large volume pouches with fitments placed along the top seal are more difficult for the user to manage, or hold, while dispensing the product. Fitments are often placed on a corner of the pouch to reduce this vibrational mode of failure when the pouches are packaged because the corner fitment has less contact with the secondary package. Corner fitmented pouches also allow for easier pouch manageability and dispensing during use because of placement of the user's hands with respect to the fitment placement. Large volume pouches tear at or near the fitment and/or experience sidewall blowout when dropped causing pouch failure or leakage due to the momentum of the large mass of product contained therein.

Thus, a need exists for a corner fitmented pouch that minimizes pouch failure due to shipping and handling issues. Further, such a pouch is needed to sufficiently accommodate large volumes of product.

SUMMARY

A package has been developed that can be used to store a product. The package includes a fitment seal and a fitment. The package can maintain its integrity during shipping and other forms of handling. The package includes at least one supplemental seal that reduces a stress at the fitment by at least partly preventing the stored product from impacting a region around the fitment. The fitment seal may therefore be protected against tears. Various configurations of the at least one supplemental seal are possible within the scope of the present disclosure.

One embodiment of the package includes a fitment. The fitment includes a fitment centerline, and a base including a first base end and a second base end. The package further includes a fitment seal, a first adjacent seal, a second adjacent seal, a fourth edge, a first supplemental seal, and a second supplemental seal. The fitment seal connects to the first adjacent seal and the second adjacent seal. A portion of the second adjacent seal opposes the fourth edge. The fitment seal includes a fitment seal angle between 90° and 180° from the first adjacent seal. The fitment seal includes the fitment. The first supplemental seal includes a position anywhere from a bisection line including a line extending from the fitment centerline, to the first adjacent seal. The second supplemental seal includes a position anywhere from the bisection line to the second adjacent seal. A first base line extends from the first base end parallel to the bisection line. A second base line extends from the second base end parallel to the bisection line. The first supplemental seal includes a first point including a point closest to the first base line. The second supplemental seal includes a second point including a point closest to the second base line. A first spacing includes a distance between the fitment seal and the first point measured along a line parallel to the bisection line. A second spacing includes a distance between the fitment seal and the second point measured along a line parallel to the bisection line. The second spacing divided by the first spacing is less than 1.

In some embodiments, the package further includes a first foundation line extending from the first base end perpendicular to a line including the fourth edge. The first supplemental seal includes a position anywhere from the first foundation line to the bisection line.

In some embodiments, the package further incudes a second foundation line extending from the second base end parallel to the fourth edge. The second supplemental seal includes a position anywhere from the second foundation line to the bisection line.

In some embodiments, each of the first supplemental seal and the second supplemental seal includes a shape that is polygonal, non-polygonal or combinations thereof.

In some embodiments, the first supplemental seal includes a position anywhere from 50 percent of a distance between the fitment seal and a line including the fourth edge from the fitment seal.

In some embodiments, the first supplemental seal extends towards the first adjacent seal and includes a first angle from 90° and 180° as measured from the first adjacent seal to the bisection line and tangentially to the first point.

In some embodiments, the first supplemental seal extends to the first adjacent seal.

In some embodiments, the second supplemental seal extends towards the second adjacent seal at a second angle from 90° and 180° as measured from the second adjacent seal to the bisection line and tangentially to the second point.

In some embodiments, the fourth edge includes a gusset.

In some embodiments, the package further includes a single compartment.

In some embodiments, the package further includes a handle.

In some embodiments, the package includes a volume of 1 liter or greater.

In some embodiments, the package contains liquid, particles, powder, or combinations thereof.

Another embodiment of the package includes a fitment including a fitment centerline, a first base end and a second base end. The package further includes a fitment seal, a first adjacent seal, a second adjacent seal, a fourth edge, and a first supplemental seal. The fitment seal connects to the first adjacent seal and the second adjacent seal. A portion of the second adjacent seal is parallel to and opposes the fourth edge. The fitment seal includes a fitment seal angle between 90° and 180° from the first adjacent seal. The fitment seal includes the fitment. A first foundation line extends from the first base end perpendicular to a line including the fourth edge. An intermediate line extends from the fitment seal parallel to the first foundation line between the first base end, and the first adjacent seal and is spaced from the first foundation line by 25 percent of a distance between the first adjacent seal and the first foundation line. The first supplemental seal includes a position anywhere from a bisection line including a line extending from the fitment centerline, to the intermediate line. Further, the package includes a single compartment.

Yet another embodiment of the package includes a fitment including a fitment centerline, a first base end and a second base end. The package further includes a fitment seal, a first adjacent seal, a second adjacent seal, a fourth edge, a first supplemental seal, and a second supplemental seal. The fitment seal connects to the first adjacent seal and the second adjacent seal. A portion of the second adjacent seal opposes the fourth edge. The fitment seal includes a fitment seal angle between 90° and 180° from the first adjacent seal. The fitment seal includes the fitment. The first supplemental seal includes a position anywhere from a bisection line including a line extending from the fitment centerline, to the first adjacent seal. The second supplemental seal includes a position anywhere from the bisection line to the second adjacent seal. A first base line extends from the first base end parallel to the bisection line. A second base line extends from the second base end parallel to the bisection line. The first supplemental seal includes a first point including a point closest to the first base line. The second supplemental seal includes a second point including a point closest to the second base line. The first supplemental seal extends towards the first adjacent seal and includes a first angle from 90° to 180° as measured from the first adjacent seal to the bisection line and tangentially to the first point. The second supplemental seal extends towards the second adjacent seal at a second angle from 90° to 180° as measured from the second adjacent seal to the bisection line and tangentially to the second point.

There are several aspects of the present subject matter which may be embodied separately or together. These aspects may be employed alone or in combination with other aspects of the subject matter described herein, and the description of these aspects together is not intended to preclude the use of these aspects separately or the claiming of such aspects separately or in different combinations.

BRIEF DESCRIPTION OF THE DRAWINGS

The disclosure may be more completely understood in consideration of the following detailed description of various embodiments of the disclosure in connection with the accompanying drawings, in which.

The figures are not necessarily to scale. Like numbers used in the figures refer to like components. It will be understood, however, that the use of a number to refer to a component in a given figure is not intended to limit the component in another figure labeled with the same number.

DETAILED DESCRIPTION

The present application describes a package including a fitment, a fitment seal, a first adjacent seal, a second adjacent seal, a fourth edge and at least one supplemental seal. The fitment seal connects to the first adjacent seal and the second adjacent seal. An angle from the first adjacent seal to the fitment seal is between 90° to 180°. A portion of the second adjacent seal opposes the fourth edge. The fitment defines a fitment center line. A bisection line extends from the fitment centerline. The at least one supplemental seal includes a position anywhere between the bisection line and the first adjacent seal. In some embodiments, the at least one supplemental seal may additionally include a position anywhere between the bisection line and the second adjacent seal.

The supplemental seal(s) may be used to improve seal integrity near the fitment of the package. During shipping or any other forms of handing, the fitment seal may be vulnerable to failure and leakage. The supplemental seal(s) may reduce a stress at the fitment by at least partly preventing a stored product from impacting a region around the fitment. Adding the supplemental seal(s) may therefore provide protection in the vicinity of the fitment, providing the package with higher durability. This durability may be especially valuable for preventing the package from failing and leaking during e-commerce distribution.

Figure 1:
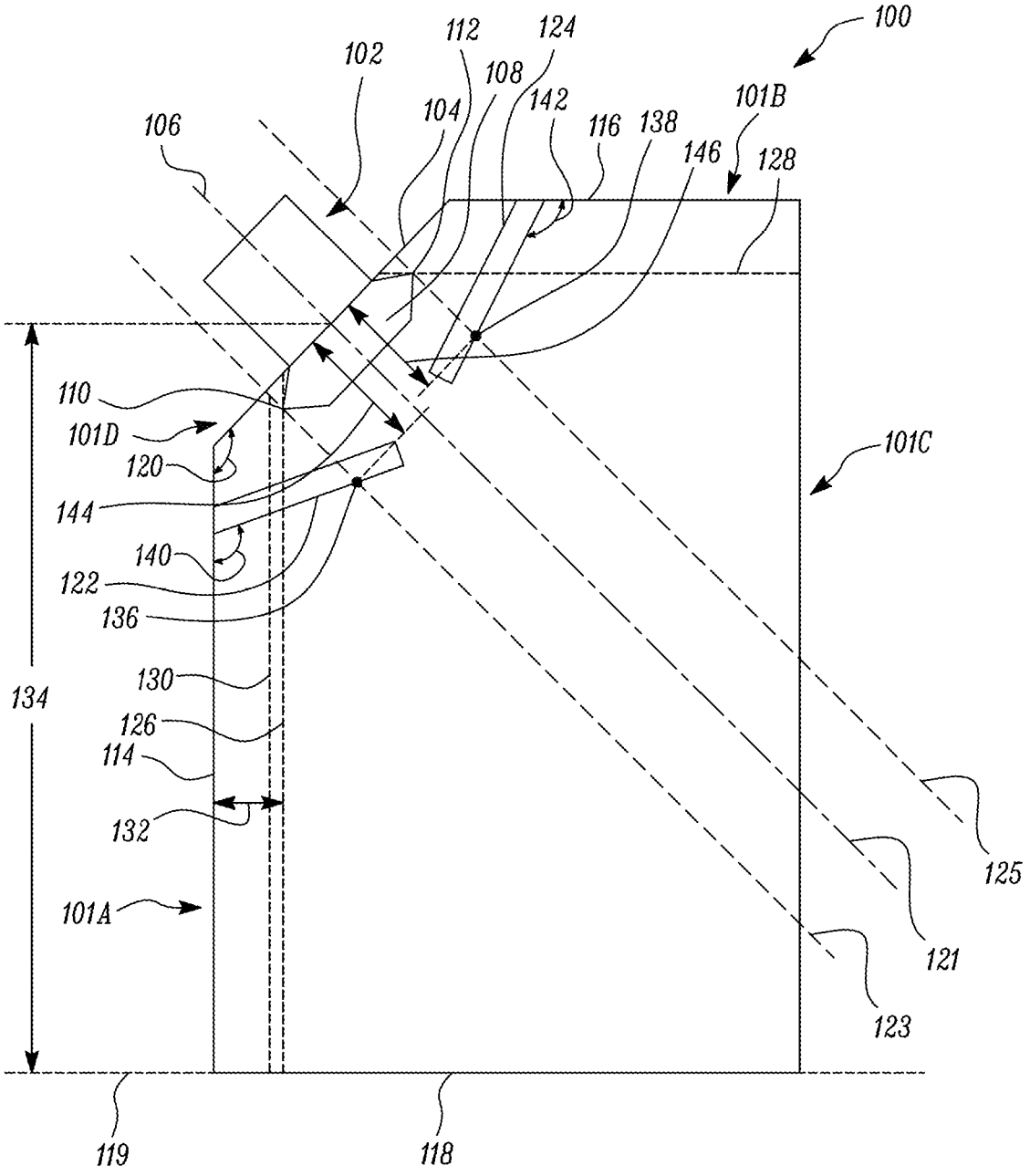
FIG. 1 is a schematic plan view of a package.

FIG. 1 is a schematic plan view of a package 100 including a fitment 102. Fitment 102 includes a fitment centerline 106 and a base 108. Base 108 includes a first base end 110 and a second base end 112. Base 108 may extend between first base end 110 and second base end 112. Package 100 further includes a fitment seal 104, a first adjacent seal 114, a second adjacent seal 116, a fourth edge 118, a first supplemental seal 122, and a second supplemental seal 124.

Fitment seal 104 connects to first adjacent seal 114 and second adjacent seal 116. Fitment seal 104 of package 100 further includes a fitment seal angle 120 between 90 degrees (°) to 180° from first adjacent seal 114. In an example, fitment seal angle 120 may be equal to 135°. Fitment seal 104 may therefore be inclined relative to first adjacent seal 114. Fitment seal 104 includes fitment 102. Fitment seal 104 and fitment 102 may form a corner portion of package 100 between first and second adjacent seals 114, 116. Fitment 102 may enable dispensing of a product contained within package 100. The package 100 may therefore be a pouch with a corner fitment. As shown in FIG. 1, fitment 102 may be centrally located on fitment seal 104. However, in alternative embodiments, fitment 102 may be off-center relative to fitment seal 104.

As shown in FIG. 1, first adjacent seal 114 extends to fourth edge 118. However, in alternative embodiments, one or more edges may be disposed between fourth edge 118, and first and/or second adjacent seals 114, 116. Specifically, depending upon the shape of package 100, fourth edge 118 may not connect with first adjacent seal 114 and/or second adjacent seal 116. In the illustrated embodiment of FIG. 1, each of fitment seal 104, first adjacent seal 114 and second adjacent seal 116 is substantially straight. In some other embodiments, at least one of fitment seal 104, first adjacent seal 114 and second adjacent seal 116 is curved. A portion of second adjacent seal 116 opposes fourth edge 118. Further, the portion of second adjacent seal 116 is parallel to fourth edge 118. As shown in FIG. 1, the whole of second adjacent seal 116 is parallel to and opposes fourth edge 118.

Package 100 has a substantially pentagonal shape. However, package 100 may have any alternative shape having a corner fitment. For example, package 100 may be hexagonal, octagonal, polygonal, curved, and so forth. The shape of package 100 may be based on application requirements.

Fitment seal 104, first adjacent seal 114, and second adjacent seal 116 may form part of a peripheral seal of package 100. Each of fitment seal 104, first adjacent seal 114, and second adjacent seal 116 may be formed from heating and compressing overlapping layers of multilayer films at the perimeter of package 100. For example, each of fitment seal 104, first adjacent seal 114, and second adjacent seal 116 may be formed from heat sealing overlapping portions of a single multilayer film or separate multilayer films. Fitment seal 104 may at least partially enclose fitment 102 in order to prevent leakage around fitment 102. In some embodiments, fourth edge 118 may also include an edge seal. Seals may be formed by any conventional means known in the art, for example, ultrasonically, with adhesive, etc.

In some embodiments, fourth edge 118 includes a gusset (not shown in FIG. 1). Package 100 may therefore be a stand-up pouch. In some embodiments, package 100 further includes a handle (not shown in FIG. 1). The handle may be formed integrally with the pouch or be an additional component to the pouch. In some embodiments, package 100 includes a single compartment. In some other embodiments, package 100 may include multiple compartments. In some embodiments, package 100 includes a volume of 1 liter or greater. Package 100 may contain any item that can be dispensed through fitment 102. In some embodiments, package 100 contains liquid, particles, powder, or combinations thereof. Liquid may include liquid food items (e.g., juice), liquid surfactants, paints, etc. Particles may include particulate food items (e.g., cereal), paint particles, detergent particles, etc. Powder may include detergent powder, cosmetics, paint powder, powdered food items (e.g., powdered sugar), etc.

Package 100 includes a body having a first edge 101A, a second edge 101B, a third edge 101C, a corner edge 101D, and fourth edge 118. First edge 101A includes first adjacent seal 114. Second edge 101B includes second adjacent seal 116. Corner edge 101D joins first and second edges 101A, 101B and includes fitment seal 104. Third edge 101C connects second edge 101B to fourth edge 118, and includes an edge seal. Body of package 100 may be made of a single or a multilayer film. Body of package 100 defines a compartment bounded by first adjacent seal 114, second adjacent seal 116, fitment seal 104, and the edge seals of third edge 101C and fourth edge 118. The compartment receives the contents of package 100. In the illustrated embodiments, each of first edge 101A, second edge 101B, third edge 101C, corner edge 101D, and fourth edge 118 is substantially straight. However, one or more of first edge 101A, second edge 101B, third edge 101C, corner edge 101D, and fourth edge 118 may be curved.

Package 100 defines several imaginary lines. Package 100 defines a bisection line 121 including a line extending from fitment centerline 106. Package 100 further defines a first base line 123 extending from first base end 110 parallel to bisection line 121. Package 100 further defines a second base line 125 extending from second base end 112 parallel to bisection line 121. Package 100 further includes a first foundation line 126 extending from first base end 110 perpendicular to a line 119 including fourth edge 118. In the illustrated embodiment of FIG. 1, first foundation line 126 may be substantially parallel to first adjacent seal 114. Package 100 further includes a second foundation line 128 extending from second base end 112 parallel to fourth edge 118. In the illustrated embodiment, second foundation line 128 is substantially parallel to second adjacent seal 116. Package 100 further defines an intermediate line 130 extending from fitment seal 104 parallel to first foundation line 126 between first base end 110 and first adjacent seal 114. Intermediate line 130 is further spaced from first foundation line 126 by 25 percent of a distance 132 between first adjacent seal 114 and first foundation line 126. First and second supplemental seals 122, 124 may be defined with respect to these imaginary lines.

First supplemental seal 122 includes a position anywhere from bisection line 121 to first adjacent seal 114. In some embodiments, first supplemental seal 122 includes a position anywhere from first foundation line 126 to bisection line 121. In some embodiments, first supplemental seal 122 includes a position anywhere from 50 percent of a distance 134 between fitment seal 104 and line 119 including fourth edge 118. Distance 134 is measured from a mid-point of fitment seal 104 and line 119. If fitment 102 is located centrally on fitment seal 104, distance 134 is measured from a point of intersection of fitment centerline 106 with fitment seal 104 and line 119. As shown in FIG. 1, first supplemental seal 122 extends to first adjacent seal 114. Further, first supplemental seal 122 extends from first adjacent seal 114 to a position between first base line 123 and bisection line 121.

However, alternative positions of first supplemental seal 122 are possible within the scope of the present application. For example, first supplemental seal 122 may include a position anywhere from bisection line 121 to intermediate line 130. In some other examples, first supplemental seal 122 may extend from first adjacent seal 114 to a position anywhere from intermediate line 130 to bisection line 121.

In some examples, first supplemental seal 122 may be spaced from first adjacent seal 114. In some examples, first supplemental seal 122 may extend from a position anywhere between first adjacent seal 114 and intermediate line 130 to a position anywhere from intermediate line 130 to bisection line 121. In some other examples, first supplemental seal 122 may extend from a position anywhere from intermediate line 130 to first foundation line 126 to a position anywhere from first foundation line 126 to bisection line 121. In another example, first supplemental seal 122 may extend from a position anywhere from first foundation line 126 to first base line 123 to a position anywhere from first base line 123 to bisection line 121. In some examples, first supplemental seal 122 may be positioned between intermediate line 130 and first foundation line 126. In some other examples, first supplemental seal 122 may be positioned between first foundation line 126 and bisection line 121. In another example, first supplemental seal 122 may be positioned between first foundation line 126 and first base line 123. In some other examples, first supplemental seal 122 may be positioned between first base line 123 and bisection line 121.

Second supplemental seal 124 includes a position anywhere from bisection line 121 to second adjacent seal 116. In some embodiments, second supplemental seal 124 includes a position anywhere from second foundation line 128 to bisection line 121. As shown in FIG. 1, second supplemental seal 124 extends to second adjacent seal 116. Further, second supplemental seal 124 extends from second adjacent seal 116 to a position between second base line 125 and bisection line 121.

However, alternative positions of second supplemental seal 124 are possible within the scope of the present application. For example, second supplemental seal 124 may extend from second adjacent seal 116 to a position anywhere from second foundation line 128 to bisection line 121. In another example, second supplemental seal 124 may extend from second adjacent seal 116 to a position anywhere between second adjacent seal 116 and second foundation line 128.

In some examples, second supplemental seal 124 may be spaced from second adjacent seal 116. In some examples, second supplemental seal 124 may extend from a position anywhere between second adjacent seal 116 and second foundation line 128 to a position anywhere from second foundation line 128 to bisection line 121. In some other examples, second supplemental seal 124 may extend from a position anywhere from second foundation line 128 to second base line 125 to a position anywhere from second base line 125 to bisection line 121. In some examples, second supplemental seal 124 may be positioned between second adjacent seal 116 and second foundation line 128. In another example, second supplemental seal 124 may be positioned between second foundation line 128 and second base line 125. In some other examples, second supplemental seal 124 may be positioned between second base line 125 and bisection line 121.

First supplemental seal 122 includes a first point 136. First point 136 includes a point closest to first base line 123. In cases where multiple points are closest to first base line 123 or at a same distance from first base line 123, then the lowermost point is selected as first point 136. The lowermost point is the point farthest from fitment seal 104 with respect to first base line 123. In other words, the lowermost point is the point closest to fourth edge 118 with respect to first base line 123. Therefore, first point 136 is a point anywhere on first supplemental seal 122 farthest from fitment seal 104 and closest to first base line 123. As shown in FIG. 1, first supplemental seal 122 intersects first base line 123. In such a case, first point 136 is the lowermost point of first supplemental seal 122 that is disposed on first base line 123. First point 136 is farthest from fitment seal 104. However, alternative positions of first point 136 are possible within the scope of present invention. Position of first point 136 may depend upon the shape and the position of first supplemental seal 122. For example, first point 136 may include a point on first supplemental seal 122 positioned between first base line 123 and bisection line 121. In some examples, first point 136 may include a point on first supplemental seal 122 positioned between first foundation line 126 and first base line 123. In some examples, first point 136 may include a point on first supplemental seal 122 positioned between first adjacent seal 114 and first foundation line 126. In case of multiple first supplemental seals (not shown in FIG. 1), the first point may be a point of the lowermost first supplemental seal that is farthest from fitment seal 104 with respect to first base line 123.

Second supplemental seal 124 includes a second point 138. Second point 138 includes a point closest to second base line 125. In cases where multiple points are closest to second base line 125 or at a same distance from second base line 125, then the lowermost point is selected as second point 138. The lowermost point is the point farthest from fitment seal 104 with respect to second base line 125. As shown in FIG. 1, second supplemental seal 124 intersects second base line 125. In such a case, second point 138 is the lowermost point of second supplemental seal 124 that is disposed on second base line 125. Second point 138 is farthest from fitment seal 104 with respect to second base line 125. However, alternative positions of second point 138 are possible within the scope of present invention. Position of second point 138 may depend upon the shape and position of second supplemental seal 124. For example, second point 138 may include a point on second supplemental seal 124 positioned between second base line 125 and bisection line 121. In some examples, second point 138 may include a point on second supplemental seal 124 positioned between second foundation line 128 and second base line 125. In some examples, second point 138 may include a point on second supplemental seal 124 positioned between second adjacent seal 116 and second foundation line 128. In case of multiple second supplemental seals (not shown in FIG. 1), the second point may be a point of the lowermost second supplemental seal that is farthest from fitment seal 104 with respect to second base line 125.

First supplemental seal 122 extends towards first adjacent seal 114 at a first angle 140 from 90° and 180° as measured from first adjacent seal 114 to bisection line 121 and tangentially to first point 136. Since first supplement seal 122 has a substantially rectangular shape in FIG. 1, first angle 140 is measured from first adjacent seal 114 to a lower edge of first supplemental seal 122 that includes first point 136. The lower edge of first supplemental seal 122 is tangential to first point 136. The measurement of first angle 140 depends on a shape of first supplemental seal 122. As shown in FIG. 1, first supplemental seal 122 may include first angle 140 less than fitment seal angle 120. First angle 140 may be greater than or equal to 90° and less than 135°. Further, first supplement seal 122 is angled away from fitment seal 104 in FIG. 1. In another example, first supplemental seal 122 may include first angle 140 equal to fitment seal angle 120. In some examples, first supplemental seal 122 may include first angle 140 greater than fitment seal angle 120.

Second supplemental seal 124 extends towards second adjacent seal 116 at a second angle 142 from 90° and 180° as measured from second adjacent seal 116 to bisection line 121 and tangentially to second point 138. Since second supplement seal 124 has a substantially rectangular shape in FIG. 1, second angle 142 is measured from second adjacent seal 116 to a lower edge of second supplemental seal 124 that includes second point 138. The lower edge of second supplemental seal 124 is tangential to second point 138. The measurement of second angle 142 depends on a shape of second supplemental seal 124. As shown in FIG. 1, second supplemental seal 124 may include second angle 142 less than fitment seal angle 120. Second angle 142 may be greater than or equal to 90° and less than 135°. Further, second supplement seal 124 is angled away from fitment seal 104 in FIG. 1. In another example, second supplemental seal 124 may include second angle 142 equal to fitment seal angle 120. In some examples, second supplemental seal 124 may include second angle 142 greater than fitment seal angle 120. In some embodiments, first angle 140 is equal to second angle 142. In some other embodiments, first angle 140 is different from second angle 142.

Package 100 further includes a first spacing 144 and a second spacing 146. First spacing 144 includes a distance between fitment seal 104 and first point 136 measured along a line parallel to bisection line 121. Second spacing 146 includes a distance between fitment seal 104 and second point 138 measured along a line parallel to bisection line 121. Second spacing 146 divided by first spacing 144 is less than 1. In other words, first spacing 144 is greater than second spacing 146. First spacing 144 may prevent first supplemental seal 122 from guiding a product to an end of second supplemental seal 124 which can otherwise cause the tearing of package 100 during movement of the package 100 or when force is applied to the package 100. Movement may include, for example, when the package 100 is dropped (e.g., a user drops the package 100) or falls from a shelf. The shape and position of each of first and second supplemental seals 122, 124 may be such that first spacing 144 is greater than second spacing 146.

As shown in FIG. 1, each of first supplemental seal 122 and second supplemental seal 124 includes a rectangular shape. First and second supplemental seals 122,124 may have a sufficient length to protect first and second base ends 110,112, respectively, that are generally susceptible to tear the package 100 in the vicinity of first and second base ends 110,112. Exact lengths of first and second supplemental seals 122, 124 may depend on fitment seal angle 120 and placement along first and second adjacent seals 114,116, respectively, of package 100. Each of first and second supplemental seals 122, 124 may include any suitable width and thickness. In some embodiments, first and second supplemental seals 122, 124 may have substantially similar shape and dimensions. In such cases, first angle 140 may be less than second angle 142 such that first spacing 144 is greater than second spacing 146. In some embodiments, each of first supplemental seal 122 and second supplemental seal 124 includes a shape that is polygonal, non-polygonal, or combinations thereof. In some cases, each of first and second supplemental seals 122, 124 may have irregular shapes. Shapes of first and second supplemental seals 122, 124 may further include circles, squares, ellipses, triangles, lines, arcs, letters, numerals, etc.

First and second supplemental seals 122,124 may be formed from heating and compressing overlapping layers of multilayer films at the perimeter of package 100. For example, first and second supplemental seals 122,124 may be formed from heat sealing overlapping portions of a single multilayer film or separate multilayer films. Seals may be formed by any conventional means known in the art by non-limiting examples that include with ultrasonic energy or adhesive.

First and second supplemental seals 122, 124, as shown in FIG. 1, are exemplary in nature. Alternative configurations of package 100 are possible within the scope of present application. For example, package 100 may include only first supplemental seal 122 and omit second supplemental seal 124.

As shown in FIG. 1, package 100 includes first and second supplemental seals 122,124 angled away from fitment seal 104 in a non-parallel configuration. The configuration of first and second supplemental seals 122, 124 in FIG. 1 may be referred to as a full non-parallel configuration. In some examples, package 100 may include first supplemental seal 122 and second supplemental seal 124 in a parallel configuration. In another example, package 100 may include first and second supplemental seals 122,124 angled towards fitment seal 104 in a non-parallel configuration. Further, first and second supplemental seals 122, 124 are continuous in FIG. 1. In alternative embodiments, at least one of first and second supplemental seals 122, 124 is discontinuous. In such cases, at least one of first and second supplement seals 122, 124 includes multiple seal portions separated from each other. Shapes and dimensions of such seal portions may be same or different.

The first and second supplemental seals 122,124 may reduce a stress at the fitment 102 by at least partly preventing a stored product from impacting a region around the fitment 102. Specifically, the first and second supplemental seals 122, 124 may protect the fitment seal 104 from failure during shipping or other forms of handling. The package 100 may therefore have higher durability as compared to conventional packages without any supplemental seals.

Figure 2B:
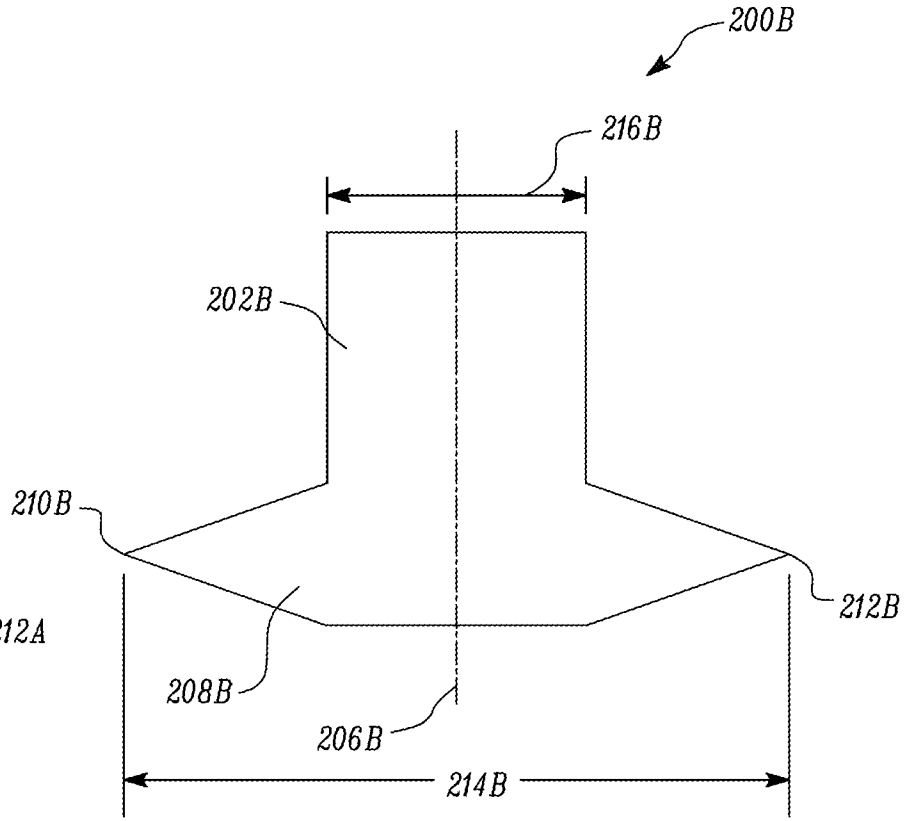
FIGS. 2A and 2B are schematic plan views of exemplary fitments used with the package.
Figure 2A:
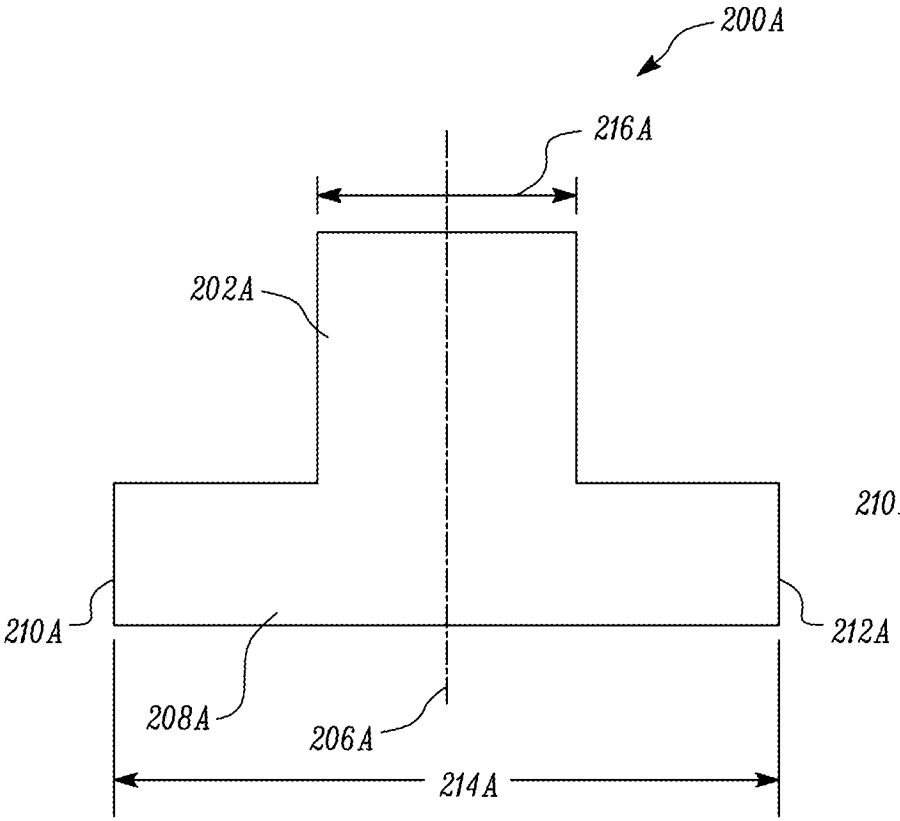

FIG. 2A shows fitment 200A in accordance with an embodiment of the present application. Fitment 200A may be used with package 100 of FIG. 1. Fitment 200A includes a fitment centerline 206A and a base 208A. Base 208A includes a first base end 210A and a second base end 212A. Base 208A includes a base width 214A. Base width 214A is less than a length of fitment seal 104 (shown in FIG. 1). For example, base width 214A may be at least 10 percent and less than 90 percent of the length of fitment seal 104 (shown in FIG. 1). Base 208A may include a circular or an elliptical shape. Fitment 200A further includes a spout 202A extending from base 208A. Spout 202A include a spout width 216A. Spout 202A may have a hollow tubular configuration. Base 208A may include a through opening in fluid communication with spout 202A for dispensing of the contents of package 100. As shown in FIG. 2A, spout width 216A is less than base width 214A. However, in some other embodiments, spout width 216A may be greater than or equal to base width 214A. Further, spout width 216A is less than the length of fitment seal 104. For example, spout width 216A may be at least 20 percent and less than 80 percent of the length of fitment seal 104. Fitment 200A may be made of a rigid plastic material.

FIG. 2B shows fitment 200B. Fitment 200B may be used with package 100 of FIG. 1. Fitment 200B includes a fitment centerline 206B, a spout 202B and a spout width 216B equivalent to fitment centerline 206A, spout 202A and spout width 216A, respectively, of fitment 200A. However, fitment 200B includes a base 208A that is canoe shaped. Base 208A includes a first base end 210B, a second base end 212B and a base width 214B. Base 208A tapers towards first and second base ends 210B, 212B. Fitment 200B may be made of a rigid plastic material.

Figure 3:
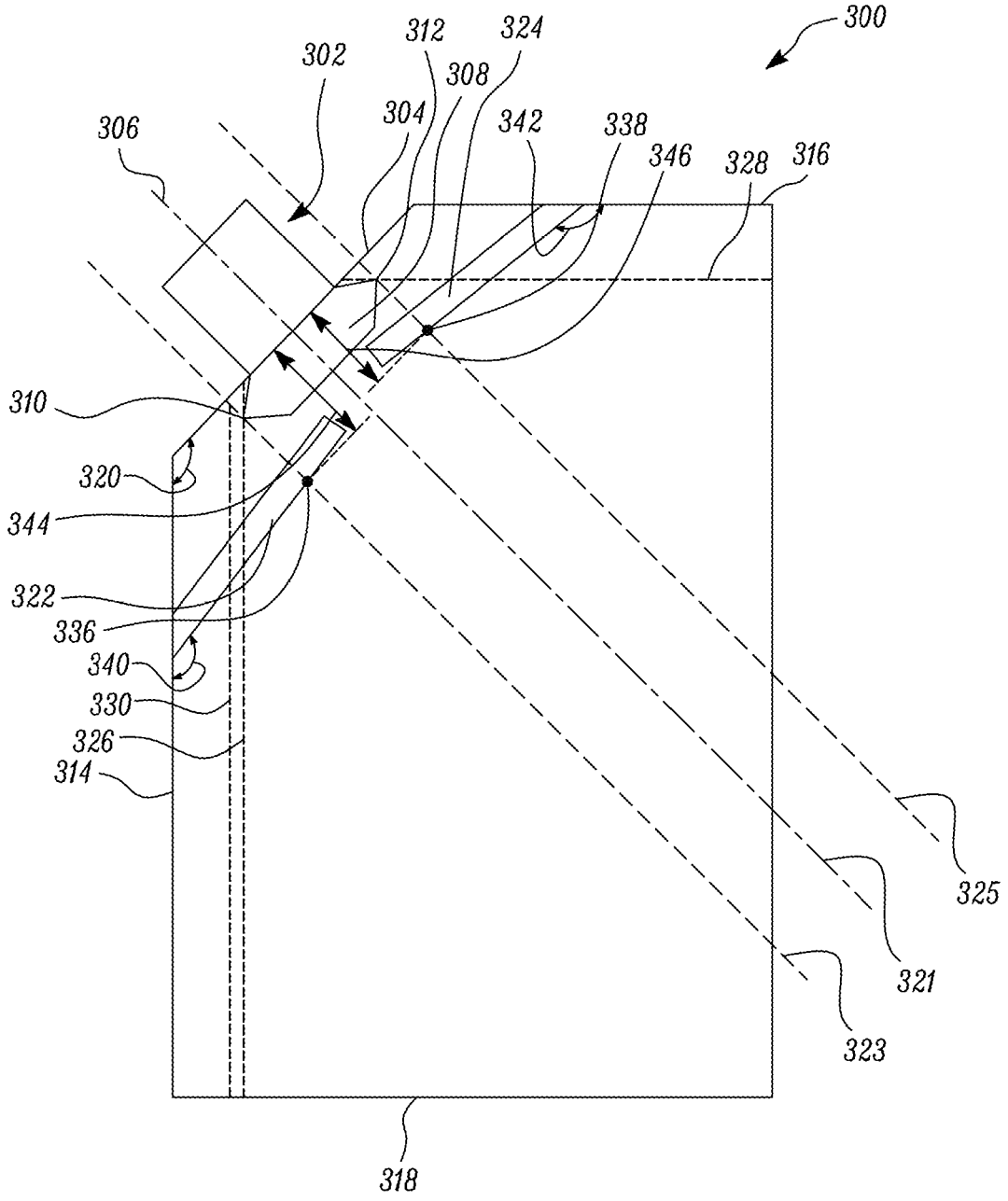
FIG. 3 is a schematic plan view of a package.

FIG. 3 is a schematic plan view of a package 300 in accordance with an embodiment of the present application. Package 300 is substantially similar to package 100 of FIG. 1. However, package 300 includes a different configuration of supplemental seals. Package 300 includes a fitment 302, a fitment seal 304, a fitment centerline 306, a base 308, a first base end 310, a second base end 312, a first adjacent seal 314, a second adjacent seal 316, a fourth edge 318, a fitment seal angle 320, a bisection line 321, a first base line 323, a second base line 325, a first foundation line 326, a second foundation line 328, and an intermediate line 330 equivalent to fitment 102, fitment seal 104, fitment centerline 106, base 108, first base end 110, second base end 112, first adjacent seal 114, second adjacent seal 116, fourth edge 118, fitment seal angle 120, bisection line 121, first base line 123, second base line 125, first foundation line 126, second foundation line 128, and intermediate line 130 of package 100.

Package 300 includes a first supplemental seal 322 and a second supplemental seal 324. As shown in FIG. 3, first and second supplemental seals 322, 324 extend to first and second adjacent seals 314, 316, respectively. First supplemental seal 322 further extends to a position between first base line 323 and bisection line 321. Each of first and second supplemental seals 322, 324 has a substantially rectangular shape. Further, each of first and second supplemental seals 322, 324 is angled towards fitment seal 304. First supplemental seal 322 includes a first point 336 closest to first base line 323. Second supplemental seal 324 includes a second point 338 closest to second base line 325. First supplemental seal 322 includes a first angle 340 as measured from first adjacent seal 314 to bisection line 321 and tangentially to first point 336. Second supplemental seal 324 includes a second angle 342 as measured from second adjacent seal 316 to bisection line 321 and tangentially to second point 338. Each of first angle 340 and second angle 342 is greater than fitment seal angle 320. A first spacing 344 includes a distance between fitment seal 304 and first point 336 measured along a line parallel to bisection line 321. A second spacing 346 includes a distance between fitment seal 304 and second point 338 measured along a line parallel to bisection line 321. Second spacing 346 divided by first spacing 344 is less than 1.

Figure 4:
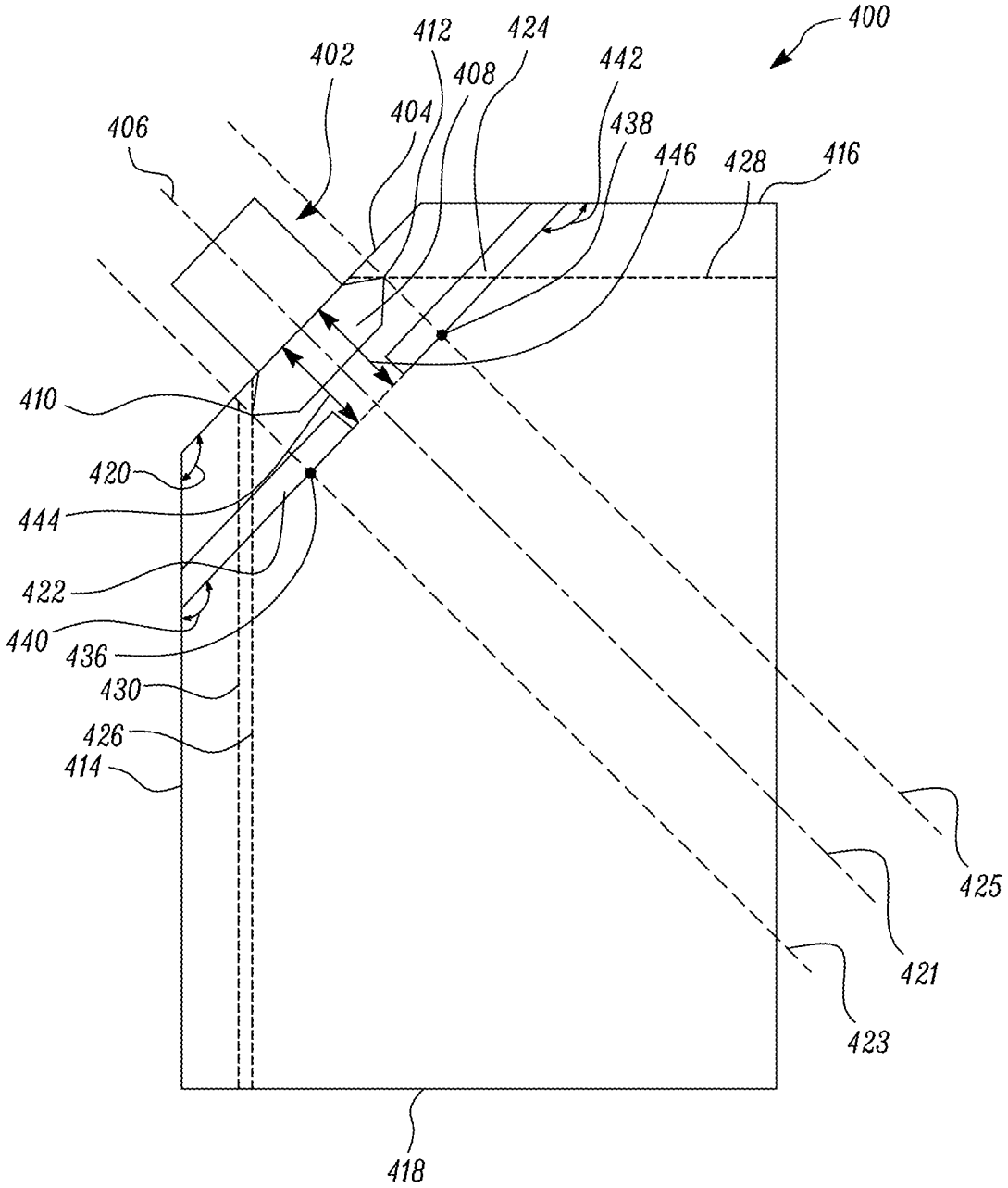
FIG. 4 is a schematic plan view of a package.

FIG. 4 is a schematic plan view of a package 400 in accordance with an embodiment of the present application. Package 400 is substantially similar to package 100 of FIG. 1. However, package 400 includes a different configuration of supplemental seals. Package 400 includes a fitment 402, a fitment seal 404, a fitment centerline 406, a base 408, a first base end 410, a second base end 412, a first adjacent seal 414, a second adjacent seal 416, a fourth edge 418, a fitment seal angle 420, a bisection line 421, a first base line 423, a second base line 425, a first foundation line 426, a second foundation line 428, and an intermediate line 430 equivalent to fitment 102, fitment seal 104, fitment centerline 106, base 108, first base end 110, second base end 112, first adjacent seal 114, second adjacent seal 116, fourth edge 118, fitment seal angle 120, bisection line 121, first base line 123, second base line 125, first foundation line 126, second foundation line 128, and intermediate line 130 of package 100.

Package 400 includes a first supplemental seal 422 and a second supplemental seal 424. As shown in FIG. 4, first and second supplemental seals 422, 424 extend to first and second adjacent seals 414, 416, respectively. First supplemental seal 422 further extends to a position between first base line 423 and bisection line 421. Second supplemental seal 424 further extends to a position between second base line 425 and bisection line 421. Each of first and second supplemental seals 422, 424 has a substantially rectangular shape. Further, first and second supplemental seals 422, 424 are in a parallel configuration. The configuration of first and second supplemental seals 422, 424 in FIG. 4 may be referred to as a full-parallel configuration. First supplemental seal 422 includes a first point 436 closest to first base line 423. Second supplemental seal 424 includes a second point 438 closest to second base line 425. First supplemental seal 422 includes a first angle 440 as measured from first adjacent seal 414 to bisection line 421 and tangentially to first point 436. Second supplemental seal 424 includes a second angle 442 as measured from second adjacent seal 416 to bisection line 421 and tangentially to second point 438. Each of first angle 440 and second angle 442 is equal to fitment seal angle 420. A first spacing 444 includes a distance between fitment seal 404 and first point 436 measured along a line parallel to bisection line 421. A second spacing 446 includes a distance between fitment seal 404 and second point 438 measured along a line parallel to bisection line 421. In some embodiments, second spacing 446 divided by first spacing 444 is equal to 1. In other words, the shape and position of each of first and second supplemental seals 422, 424 is such that first spacing 444 is equal to second spacing 446. However, in alternative embodiments, second spacing 446 divided by first spacing 444 is less than 1.

Figure 5:
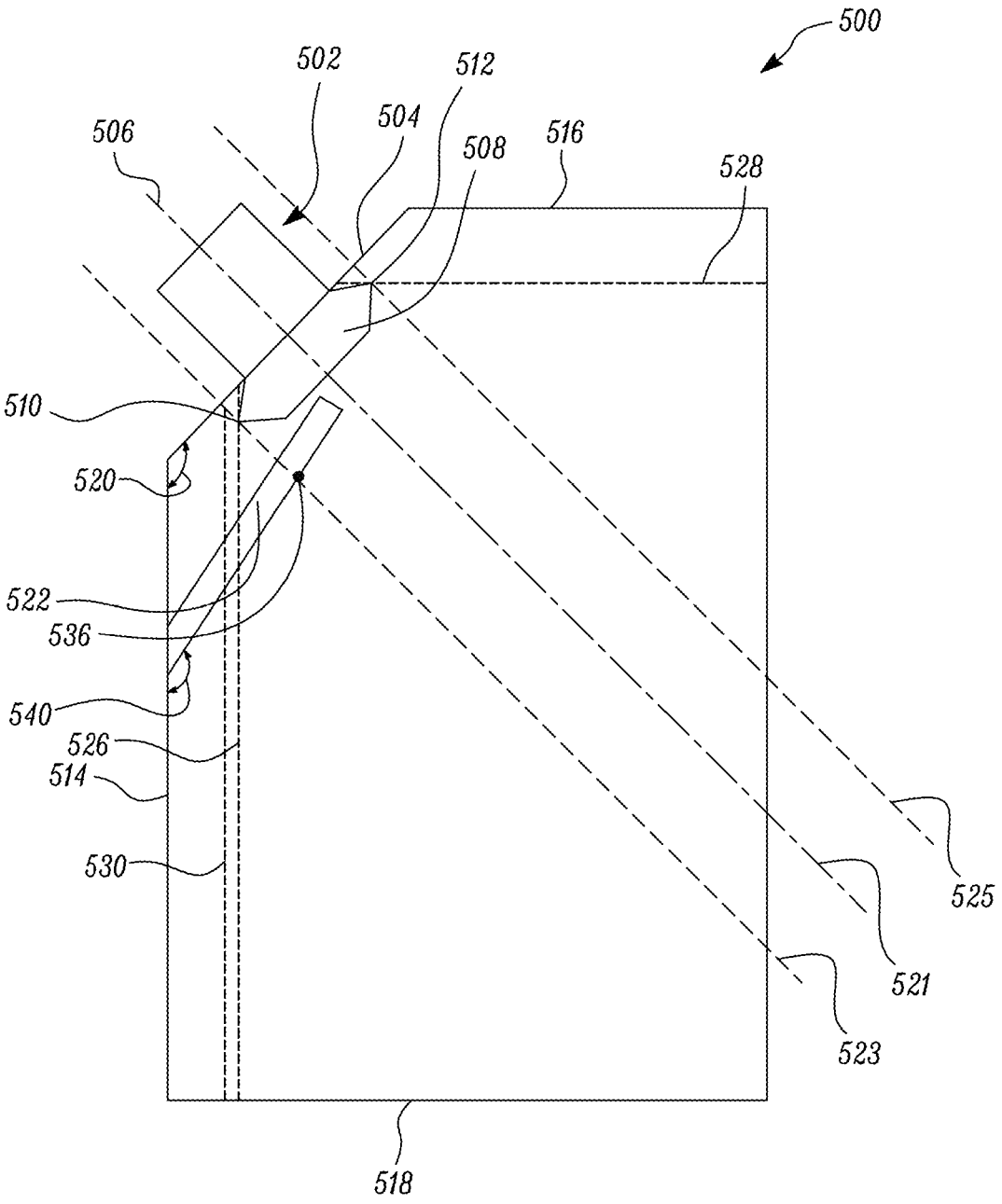
FIG. 5 is a schematic plan view of a package.

FIG. 5 is a schematic plan view of a package 500 in accordance with an embodiment of the present application. Package 500 is substantially similar to package 100 of FIG. 1. However, package 500 includes a different configuration of supplemental seals. Package 500 includes a fitment 502, a fitment seal 504, a fitment centerline 506, a base 508, a first base end 510, a second base end 512, a first adjacent seal 514, a second adjacent seal 516, a fourth edge 518, a fitment seal angle 520, a bisection line 521, a first base line 523, a second base line 525, a first foundation line 526, a second foundation line 528, and an intermediate line 530 equivalent to fitment 102, fitment seal 104, fitment centerline 106, base 108, first base end 110, second base end 112, first adjacent seal 114, second adjacent seal 116, fourth edge 118, fitment seal angle 120, bisection line 121, first base line 123, second base line 125, first foundation line 126, second foundation line 128, and intermediate line 130 of package 100.

Package 500 includes a first supplemental seal 522. Further, a second supplemental seal is absent in package 500. As shown in FIG. 5, first supplemental seal 522 extends to first adjacent seal 514. First supplemental seal 522 further extends to a position between first base line 523 and bisection line 521. First supplemental seal 522 has a substantially rectangular shape. Further, first supplemental seal 522 is angled towards fitment seal 504. The configuration of first supplemental seal 522 shown in FIG. 5 may be referred to as a half-angle configuration. First supplemental seal 522 includes a first point 536 closest to first base line 523. First supplemental seal 522 includes a first angle 540 as measured from first adjacent seal 514 to bisection line 521 and tangentially to first point 536. First angle 540 is greater than fitment seal angle 520.

Figure 6:
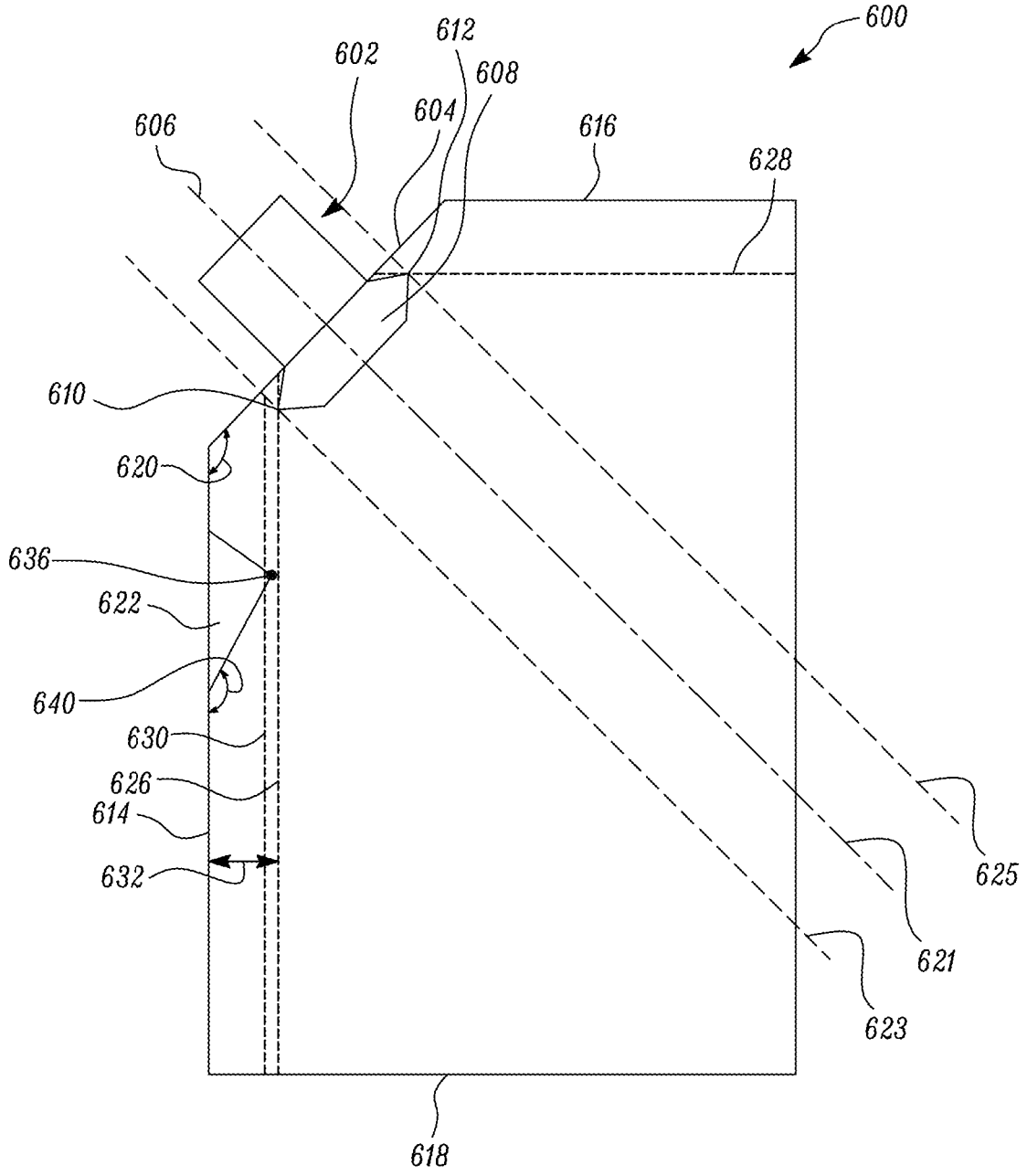
FIG. 6 is a schematic plan view of a package.

FIG. 6 is a schematic plan view of a package 600 in accordance with an embodiment of the present application. Package 600 is substantially similar to package 100 of FIG. 1. However, package 600 includes a different configuration of supplemental seals. Package 600 includes a fitment 602, a fitment seal 604, a fitment centerline 606, a base 608, a first base end 610, a second base end 612, a first adjacent seal 614, a second adjacent seal 616, a fourth edge 618, a fitment seal angle 620, a bisection line 621, a first base line 623, a second base line 625, a first foundation line 626, a second foundation line 628, and an intermediate line 630 equivalent to fitment 102, fitment seal 104, fitment centerline 106, base 108, first base end 110, second base end 112, first adjacent seal 114, second adjacent seal 116, fourth edge 118, fitment seal angle 120, bisection line 121, first base line 123, second base line 125, first foundation line 126, second foundation line 128, and intermediate line 130 of package 100.

Package 600 includes a first supplemental seal 622. Further, a second supplemental seal is absent in package 600. First supplemental seal 622 includes a position anywhere from bisection line 621 to intermediate line 630. As shown in FIG. 6, first supplemental seal 622 extends from first adjacent seal 614. First supplemental seal 622 further extends to a position between intermediate line 630 and first foundation line 626. First supplemental seal 622 has a substantially triangular shape. Further, first supplemental seal 622 is angled towards fitment seal 604. First supplemental seal 622 includes a first point 636 closest to first base line 623. First point 636 is a vertex of the triangular shape of first supplemental seal 622 closest to first base line 623. As shown in FIG. 6, first point 636 is located between intermediate line 630 and first foundation line 626. In alternative embodiments, first point 636 may be located on intermediate line 630. As such, first supplemental seal 622 extends at least 75 percent of a distance 632 between first adjacent seal 614 and first foundation line 626. In other words, a distance between first point 636 and first foundation line 626 is less than or equal to 25 percent of distance 632 between first adjacent seal 614 and first foundation line 626.

First supplemental seal 622 includes a first angle 640 as measured from first adjacent seal 614 to bisection line 621 and tangentially to first point 636. Since first supplement seal 622 has a substantially triangular shape in FIG. 6, first angle 640 is measured from first adjacent seal 614 to a lower edge of first supplemental seal 622 that includes first point 636. The lower edge of first supplemental seal 622 is tangential to first point 636. First angle 640 is greater than fitment seal angle 620. The configuration of first supplemental seal 622 shown in FIG. 6 may be referred to as a triangular configuration.

Figure 7:
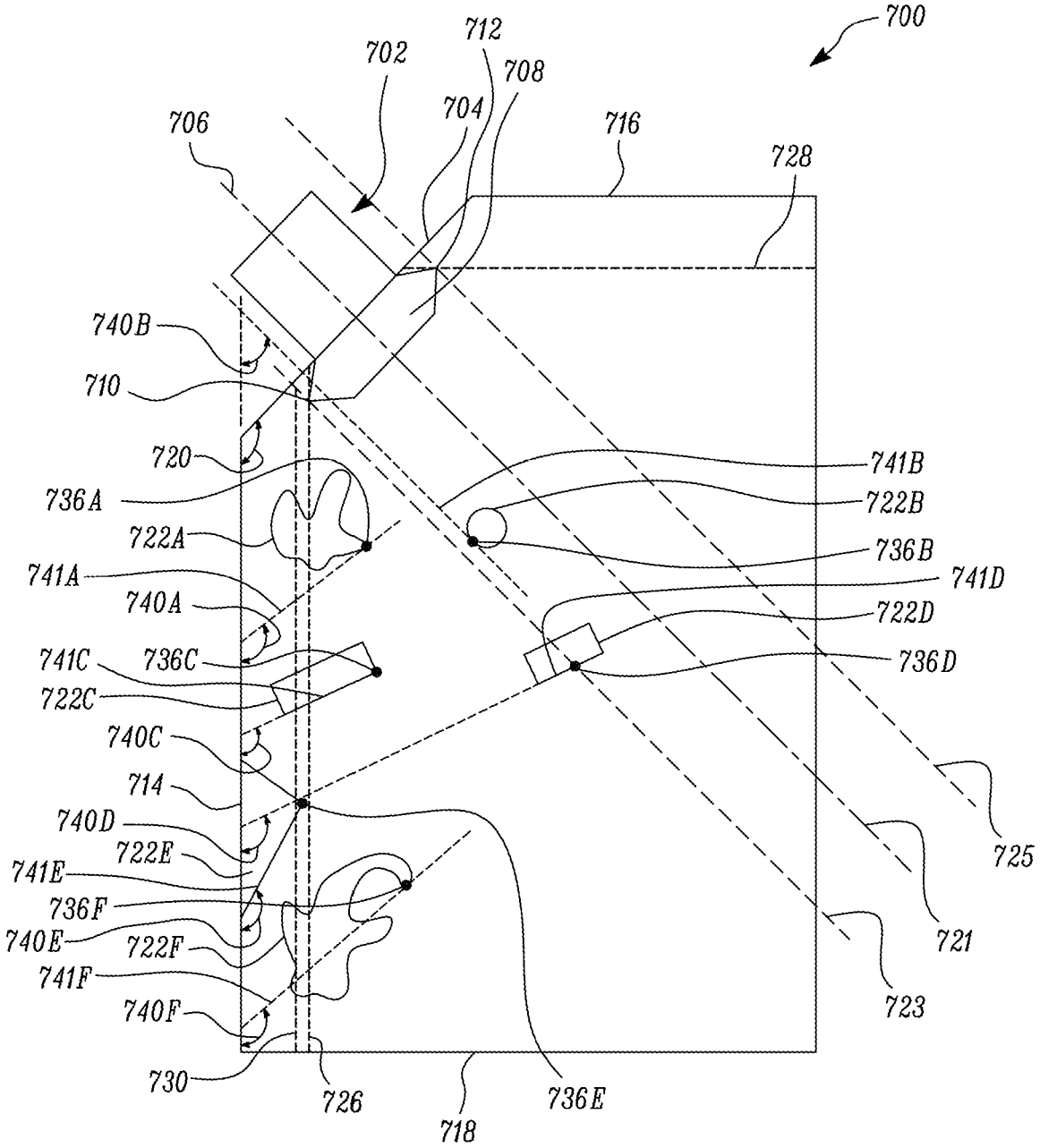
FIG. 7 is a schematic plan view of a package.

FIG. 7 is a schematic plan view of a package 700 in accordance with an embodiment of the present application. Package 700 is substantially similar to package 100 of FIG. 1. However, package 700 includes a different configuration of supplemental seals. Package 700 includes a fitment 702, a fitment seal 704, a fitment centerline 706, a base 708, a first base end 710, a second base end 712, a first adjacent seal 714, a second adjacent seal 716, a fourth edge 718, a fitment seal angle 720, a bisection line 721, a first base line 723, a second base line 725, a first foundation line 726, a second foundation line 728, and an intermediate line 730 equivalent to fitment 102, fitment seal 104, fitment centerline 106, base 108, first base end 110, second base end 112, first adjacent seal 114, second adjacent seal 116, fourth edge 118, fitment seal angle 120, bisection line 121, first base line 123, second base line 125, first foundation line 126, second foundation line 128, and intermediate line 130 of package 100.

Package 700 includes multiple first supplemental seals 722A-722F. First supplemental seals 722A-722F can have different shapes that may be polygonal, non-polygonal, irregular, or combinations thereof. First supplemental seals 722A-722F can be positioned in different locations between first adjacent seal 714 and bisection line 721. First supplemental seals 722A-722F can also be located at different distances from fitment seal 704. Though first supplemental seals 722A-722F are only illustrated in FIG. 7, package 700 may also include a similar configuration of second supplemental seals.

As shown in FIG. 7, first supplemental seal 722A is nearest to fitment seal 704. First supplemental seal 722A has an irregular shape. First supplemental seal 722A extends from a position between first adjacent seal 714 and intermediate line 730 to a position between first foundation line 726 and first base line 723. First supplemental seal 722A includes a first point 736A closest to first base line 723. First point 736A is farthest from fitment seal 704 as compared to other points that are located at a similar distance from first base line 723. First supplemental seal 722A further includes a first angle 740A measured from first adjacent seal 714 to a tangent 741A at first point 736A.

First supplemental seal 722B is located below first supplemental seal 722A. First supplemental seal 722B has a substantially circular shape. First supplemental seal 722B is located between first base line 723 and bisection line 721. First supplemental seal 722B includes a first point 736B closest to first base line 723. First supplemental seal 722B further includes a first angle 740B measured from first adjacent seal 714 to a tangent 741B at first point 736B.

First supplemental seal 722C is located below first supplemental seal 722A. First supplemental seal 722C has a substantially rectangular shape. First supplemental seal 722C extends from a position between first adjacent seal 714 and intermediate line 730 to a position between first foundation line 726 and first base line 723. First supplemental seal 722C includes a first point 736C closest to first base line 723. First point 736C is farthest from fitment seal 704 as compared to other points that are located at a similar distance from first base line 723. Specifically, first point 736C is a vertex of a lower edge 741C of the rectangular shape of first supplemental seal 722C such that the vertex is closest to first base line 723. First supplemental seal 722C further includes a first angle 740C measured from first adjacent seal 714 to lower edge 741C including first point 736C.

First supplemental seal 722D is located below first supplemental seal 722A. First supplemental seal 722D has a substantially rectangular shape. First supplemental seal 722D extends from a position between first foundation line 726 and first base line 723 to a position between first base line 723 and bisection line 721. First supplemental seal 722D includes a first point 736D closest to first base line 723. First point 736D is farthest from fitment seal 704 as compared to other points that are located at a similar distance from first base line 723. Specifically, first point 736D is located on first base line 723 as first supplemental seal 722D intersects first base line 723. Further, first point 736D is located on a lower edge 741D of the rectangular shape of first supplemental seal 722D. First supplemental seal 722D further includes a first angle 740D measured from first adjacent seal 714 to lower edge 741D including first point 736D. As shown in FIG. 7, an area of first supplemental seal 722D between first base line 723 and bisection line 721 is less than an area between first base line 723 and first foundation line 726. However, in an alternative embodiment, the area of first supplemental seal 722D between first base line 723 and bisection line 721 is greater than the area between first base line 723 and first foundation line 726.

First supplemental seal 722E is located below first supplemental seal 722A. First supplemental seal 722E has a substantially triangular shape. First supplemental seal 722E extends from first adjacent seal 714 to a position between intermediate line 730 and first foundation line 726. First supplemental seal 722E includes a first point 736E closest to first base line 723. Specifically, first point 736E is a vertex of the triangular shape of first supplemental seal 722E that is closest to first base line 723. First point 736E is further located on a lower edge 741E of the triangular shape. First supplemental seal 722E further includes a first angle 740E measured from first adjacent seal 714 to lower edge 741E including first point 736E.

First supplemental seal 722F is located below first supplemental seal 722A. First supplemental seal 722F has an irregular shape. First supplemental seal 722F extends from a position between first adjacent seal 714 and intermediate line 730 to a position between first foundation line 726 and first base line 723. First supplemental seal 722F includes a first point 736F closest to first base line 723. First supplemental seal 722F further includes a first angle 740F measured from first adjacent seal 714 to a tangent 741F at first point 736F.

Figure 8:
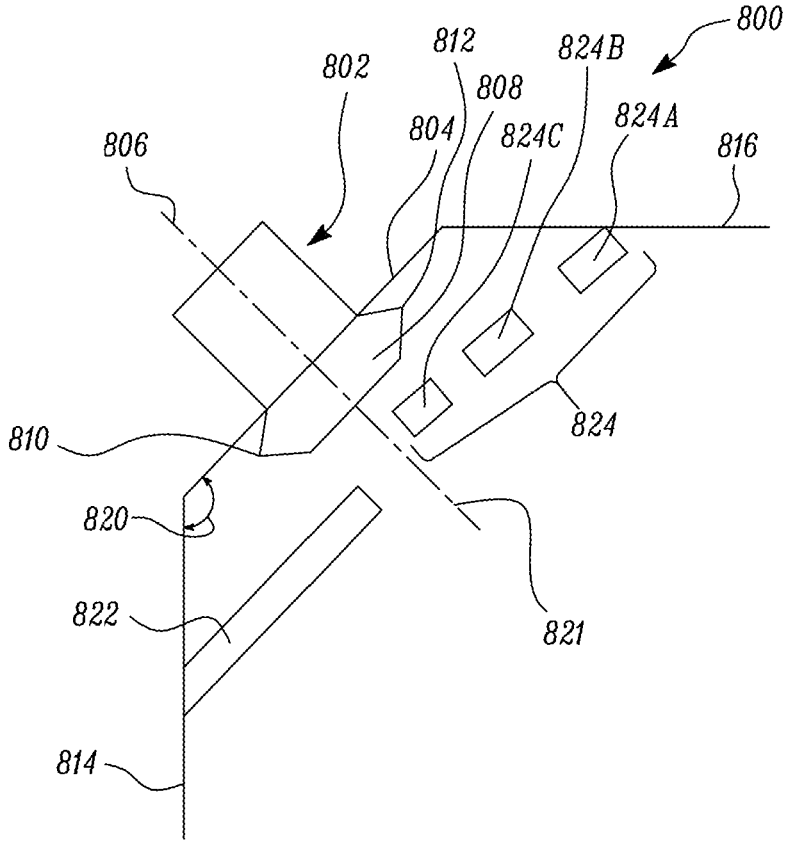
FIG. 8 is a partial schematic plan view of a package.

FIG. 8 is a partial schematic plan view of a package 800 in accordance with an embodiment of the present application. Package 800 is substantially similar to package 100 of FIG. 1. However, package 800 includes a different configuration of supplemental seals. Package 800 includes a fitment 802, a fitment seal 804, a fitment centerline 806, a base 808, a first base end 810, a second base end 812, a first adjacent seal 814, a second adjacent seal 816, a fitment seal angle 820, and a bisection line 821 equivalent to fitment 102, fitment seal 104, fitment centerline 106, base 108, first base end 110, second base end 112, first adjacent seal 114, second adjacent seal 116, fitment seal angle 120, and bisection line 121 of package 100.

Package 800 includes a first supplemental seal 822 and a second supplemental seal 824. First supplemental seal 822 is continuous. First supplemental seal 822 is substantially rectangular and extends from first adjacent seal 814. Second supplemental seal 824 is discontinuous or non-continuous. Second supplemental seal 824 includes a first portion 824A, a second portion 824B and a third portion 824C spaced apart from each other. Each of first portion 824A, second portion 824B and third portion 824C is substantially rectangular. Areas of first portion 824A, second portion 824B and third portion 824C may be equal or different. First portion 824A extends from second adjacent seal 816. Third portion 824C is closest to bisection line 821. Second portion 824B is disposed between first and third portions 824A, 824C. Further, alternative configurations of first and second supplemental seals 822, 824 are possible within the scope of the present application. For example, first supplemental seal 822 may be discontinuous or non-continuous. In other examples, second supplemental seal 824 may be continuous.

Figure 9:
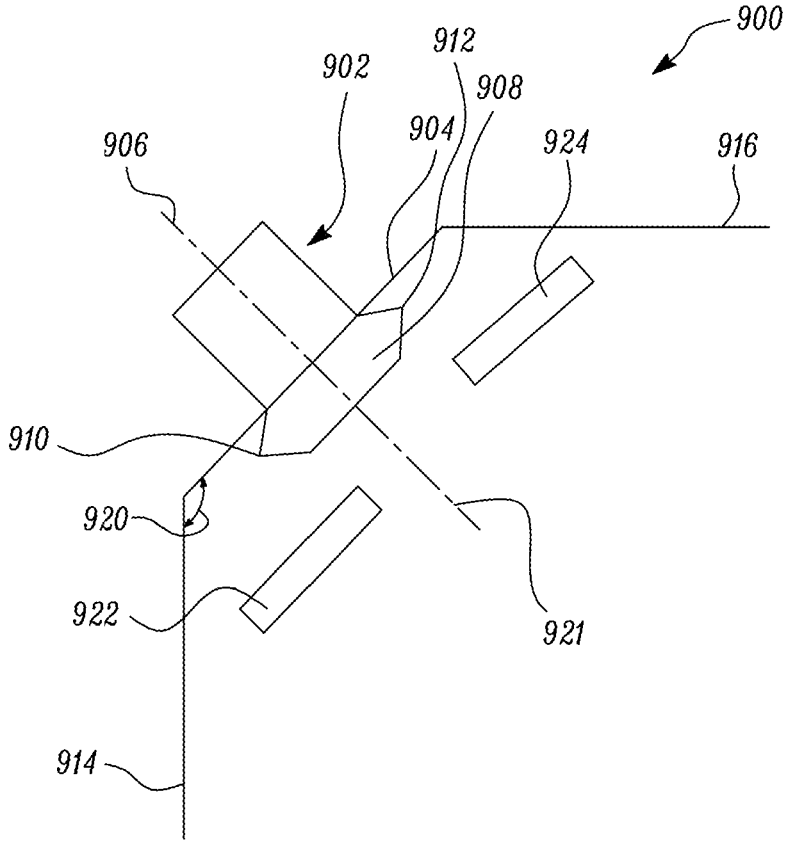
FIG. 9 is a partial schematic plan view of a package.

FIG. 9 is a partial schematic plan view of a package 900 in accordance with an embodiment of the present application. Package 900 is substantially similar to package 100 of FIG. 1. However, package 900 includes a different configuration of supplemental seals. Package 900 includes a fitment 902, a fitment seal 904, a fitment centerline 906, a base 908, a first base end 910, a second base end 912, a first adjacent seal 914, a second adjacent seal 916, a fitment seal angle 920, and a bisection line 921 equivalent to fitment 102, fitment seal 104, fitment centerline 106, base 108, first base end 110, second base end 112, first adjacent seal 114, second adjacent seal 116, fitment seal angle 120, and bisection line 121 of package 100.

Package 900 includes a first supplemental seal 922 and a second supplemental seal 924. Each of first and second supplemental seals 922, 924 is substantially rectangular. Each of first and second supplemental seals 922, 924 is further continuous. First supplemental seal 922 is spaced apart from first adjacent seal 914. Further, second supplemental seal 924 is spaced from second adjacent seal 916. An area of first supplemental seal 922 is substantially equal to an area of second supplemental seal 924.

Figure 10:
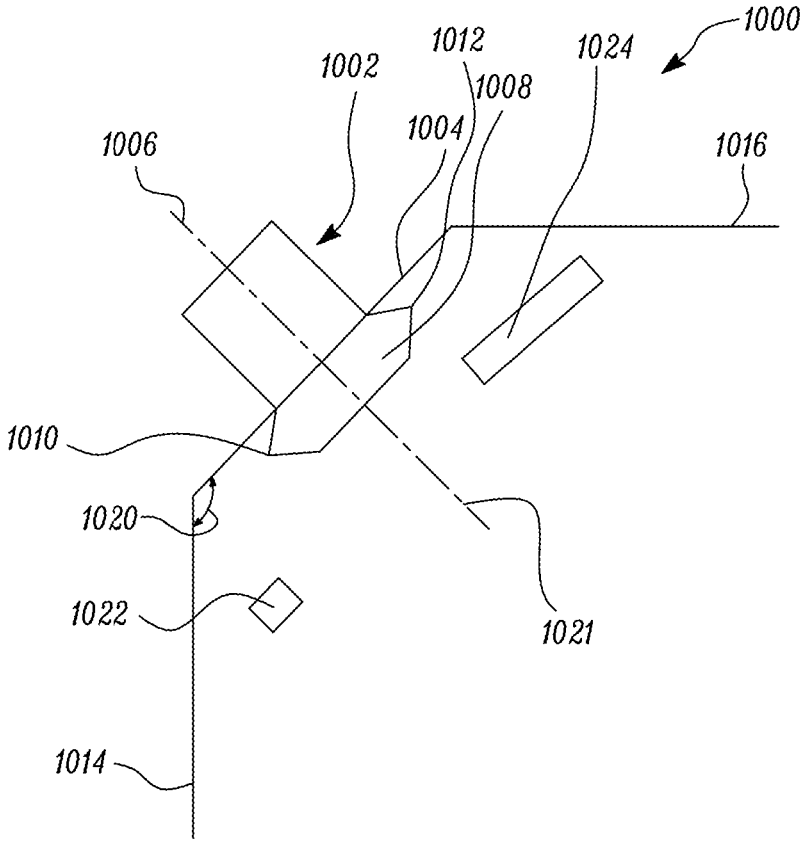
FIG. 10 is a partial schematic plan view of a package.

FIG. 10 is a partial schematic plan view of a package 1000 in accordance with an embodiment of the present application. Package 1000 is substantially similar to package 100 of FIG. 1. However, package 1000 includes a different configuration of supplemental seals. Package 1000 includes a fitment 1002, a fitment seal 1004, a fitment centerline 1006, a base 1008, a first base end 1010, a second base end 1012, a first adjacent seal 1014, a second adjacent seal 1016, a fitment seal angle 1020, and a bisection line 1021 equivalent to fitment 102, fitment seal 104, fitment centerline 106, base 108, first base end 110, second base end 112, first adjacent seal 114, second adjacent seal 116, fitment seal angle 120, and bisection line 121 of package 100.

Package 1000 includes a first supplemental seal 1022 and a second supplemental seal 1024. Each of first and second supplemental seals 1022, 1024 is continuous and substantially rectangular. First supplemental seal 1022 is spaced apart from first adjacent seal 1014. Further, second supplemental seal 1024 is spaced from second adjacent seal 1016. An area of first supplemental seal 1022 is less than an area of second supplemental seal 1024.

Figure 11:
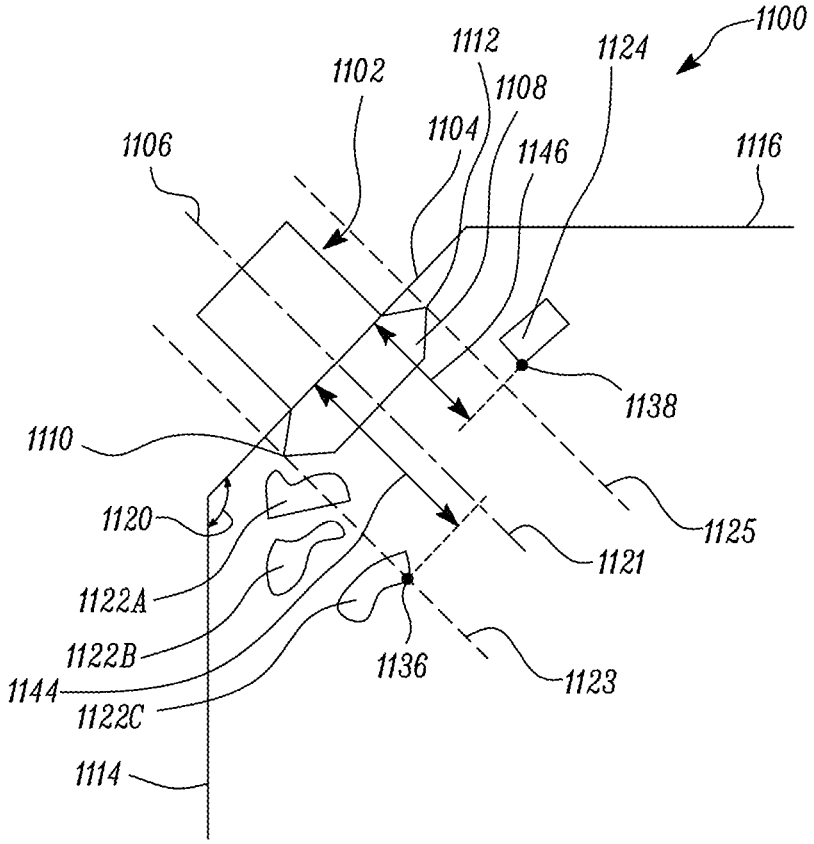
FIG. 11 is a partial schematic plan view of a package.

FIG. 11 is a partial schematic plan view of a package 1100 in accordance with an embodiment of the present application. Package 1100 is substantially similar to package 100 of FIG. 1. However, package 1100 includes a different configuration of supplemental seals. Package 1100 includes a fitment 1102, a fitment seal 1104, a fitment centerline 1106, a base 1108, a first base end 1110, a second base end 1112, a first adjacent seal 1114, a second adjacent seal 1116, a fitment seal angle 1120, a bisection line 1121, a first base line 1123, and a second base line 1125 equivalent to fitment 102, fitment seal 104, fitment centerline 106, base 108, first base end 110, second base end 112, first adjacent seal 114, second adjacent seal 116, fitment seal angle 120, bisection line 121, first base line 123, and second base line 125 of package 100.

Package 1100 includes multiple first supplemental seals 1122A, 1122B and 1122C and a second supplemental seal 1124. Each of first supplemental seals 1122A, 1122B, 1122C has an irregular shape and is spaced apart from first adjacent seal 1114. In case of multiple first supplemental seals 1122A, 1122B and 1122C, a first point 1136 is a point of first supplemental seal 1122C that is farthest from fitment seal 1104 with respect to first base line 1123, that is, closest to first base line 1123. In other words, the lowermost first supplemental seal, i.e., first supplemental seal 1122C includes first point 1136. Second supplemental seal 1124 has a substantially rectangular shape and is spaced apart from second adjacent seal 1116. Second supplemental seal 1124 further includes a second point 1138 that is a point of second supplemental seal 1124 that is farthest from fitment seal 1104 with respect to second base line 1125, that is, closest to second base line 1125. A first spacing 1144 includes a distance between fitment seal 1104 and first point 1136 measured along a line parallel to bisection line 1121. A second spacing 1146 includes a distance between fitment seal 1104 and second point 1138 measured along a line parallel to bisection line 1121. Second spacing 1146 divided by first spacing 1144 is less than 1.

Figure 12:
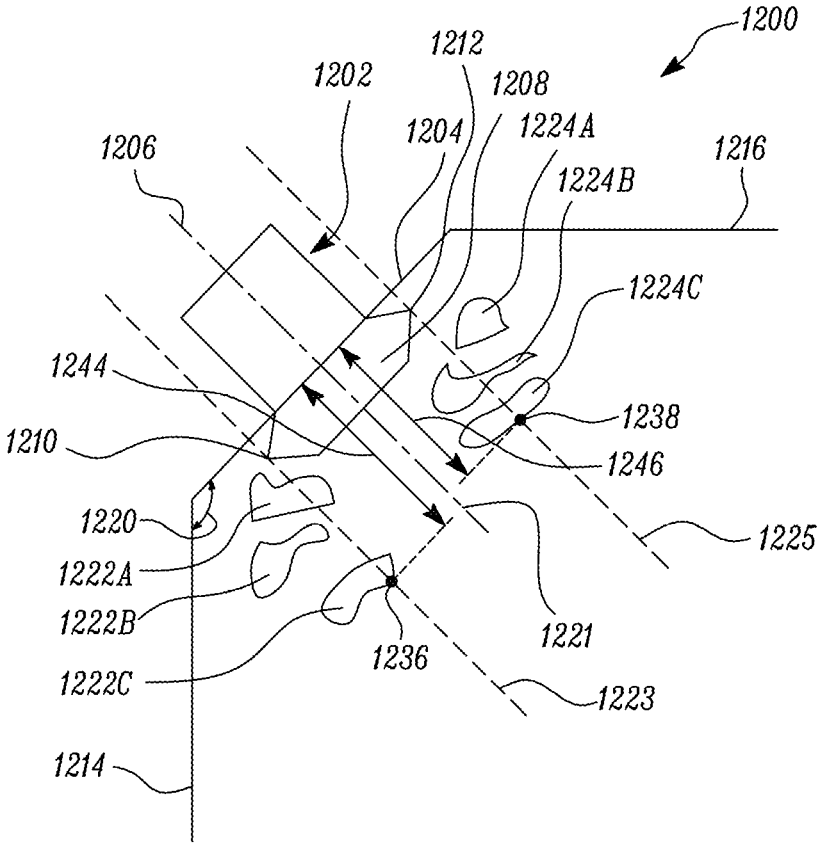
FIG. 12 is a partial schematic plan view of a package.

FIG. 12 is a partial schematic plan view of a package 1200 in accordance with an embodiment of the present application. Package 1200 is substantially similar to package 100 of FIG. 1. However, package 1200 includes a different configuration of supplemental seals. Package 1200 includes a fitment 1202, a fitment seal 1204, a fitment centerline 1206, a base 1208, a first base end 1210, a second base end 1212, a first adjacent seal 1214, a second adjacent seal 1216, a fitment seal angle 1220, a bisection line 1221, a first base line 1223, and a second base line 1225 equivalent to fitment 102, fitment seal 104, fitment centerline 106, base 108, first base end 110, second base end 112, first adjacent seal 114, second adjacent seal 116, fitment seal angle 120, bisection line 121, first base line 123, and second base line 125 of package 100.

Package 1200 includes multiple first supplemental seals 1222A, 1222B and 1222C and multiple second supplemental seals 1224A, 1224B and 1224C. In case of multiple first supplemental seals 1222A, 1222B and 1222C, a first point 1236 is a point of first supplemental seal 1222C that is farthest from fitment seal 1204 with respect to first base line 1223. In other words, the lowermost first supplemental seal, i.e., first supplemental seal 1222C includes first point 1236. In case of multiple second supplemental seals 1224A, 1224B and 1224C, a second point 1238 is a point of second supplemental seal 1224C that is farthest from fitment seal 1204 with respect to second base line 1225. In other words, the lowermost second supplemental seal, i.e., second supplemental seal 1224C includes second point 1238. Each of first supplemental seals 1222A, 1222B and 1222C has an irregular shape. Similarly, each of second supplemental seals 1224A, 1224B and 1224C has an irregular shape. A first spacing 1244 includes a distance between fitment seal 1204 and first point 1236 measured along a line parallel to bisection line 1221. A second spacing 1246 includes a distance between fitment seal 1204 and second point 1238 measured along a line parallel to bisection line 1221. Second spacing 1246 divided by first spacing 1244 is less than 1. In some embodiments, first supplemental seals 1222A, 1222B and 1222C may be joined to each other by sealed lines. In some embodiments, second supplemental seals 1224A, 1224B and 1224C may be joined to each other by sealed lines.

Figure 13:
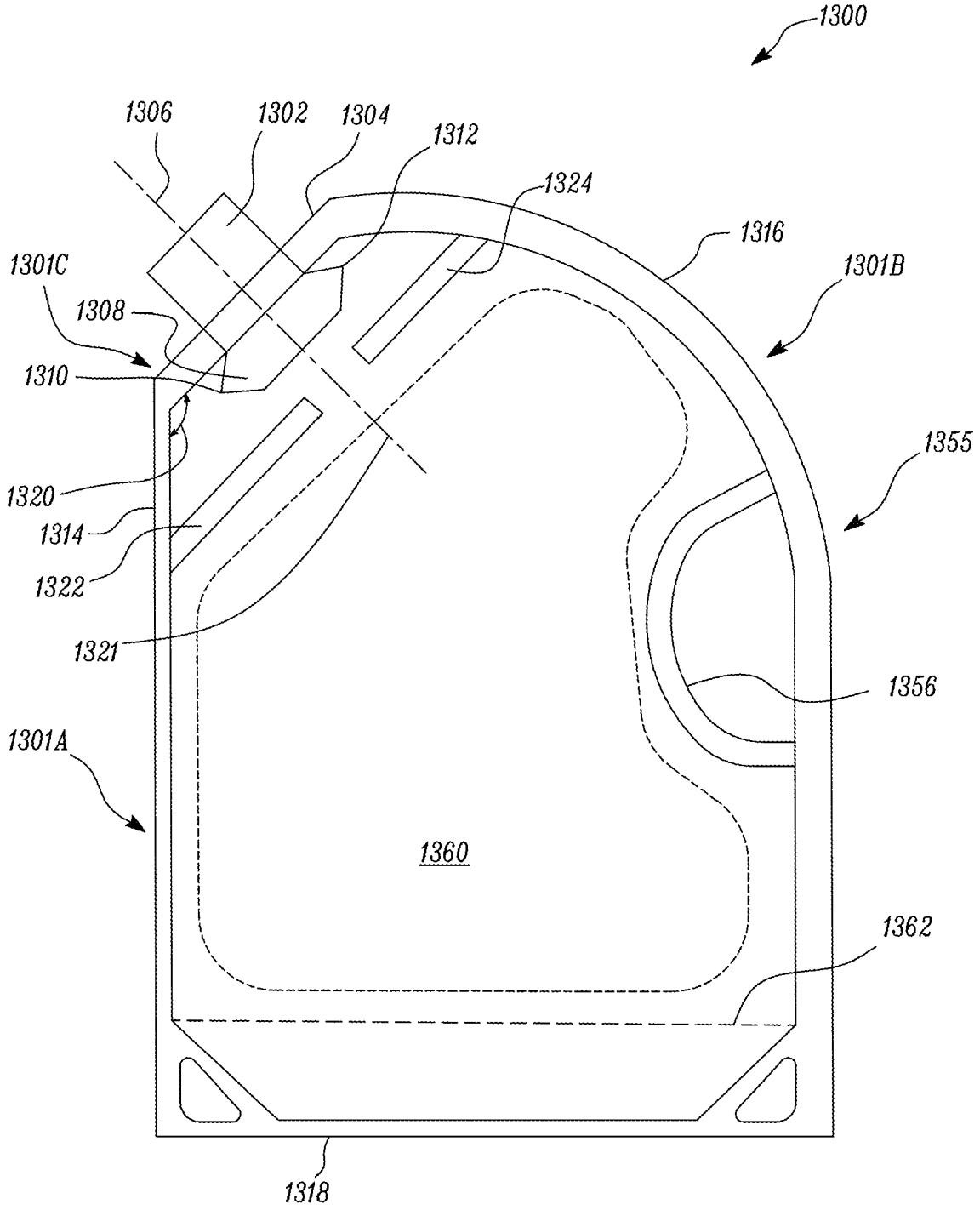
FIG. 13 is a schematic plan view of a package having a handle.

FIG. 13 is a schematic plan view of a package 1300 in accordance with an embodiment of the present application. Package 1300 includes a fitment 1302, a fitment seal 1304, a fitment centerline 1306, a base 1308, a first base end 1310, a second base end 1312, a first adjacent seal 1314, a second adjacent seal 1316, a fourth edge 1318, a fitment seal angle 1320, a bisection line 1321, a first supplemental seal 1322 and a second supplemental seal 1324 equivalent to fitment 102, fitment seal 104, fitment centerline 106, base 108, first base end 110, second base end 112, first adjacent seal 114, second adjacent seal 116, fourth edge 118, fitment seal angle 120, bisection line 121, first supplemental seal 122 and second supplemental seal 124 of package 100 shown in FIG. 1. Package 1300 further includes a first edge 1301A including first adjacent seal 1314, a second edge 1301B including second adjacent seal 1316 and a corner edge 1301C including fitment seal 1304. First edge 1301A is substantially linear and extends to fourth edge 1318. Second edge 1301B is curved and extends to fourth edge 1318.

Package 1300 includes a handle 1355 located adjacent to second edge 1301B. Handle 1355 is at least partly defined by a sealed loop 1356 extending from second edge 1301B. Handle 1355 may have various shapes, such as round, polygonal, curvilinear, irregular, etc. Handle 1355 may facilitate manual gripping and handling of package 1300.

Package 1300 further includes a single compartment 1360. Compartment 1360 receives contents of package 1300, such as liquid, particles, powder, or combinations thereof.

Package 1300 further includes a gusset 1362. As shown in FIG. 13, fourth edge 1318 includes gusset 1362. Gusset 1362 may extend substantially perpendicular to first edge 1301A. Gusset 1362 may form two folded regions (not shown) at fourth edge 1318. Fourth edge 1318 may include two edge seals (not shown) to form a generally "V" shaped pocket, thereby forming gusset 1362. Gusset 1362 may allow package 1300 to be free standing. Package 1300 may therefore be a stand-up pouch. Gusset 1362 may be formed by folding or by an insert.

Figure 14A:
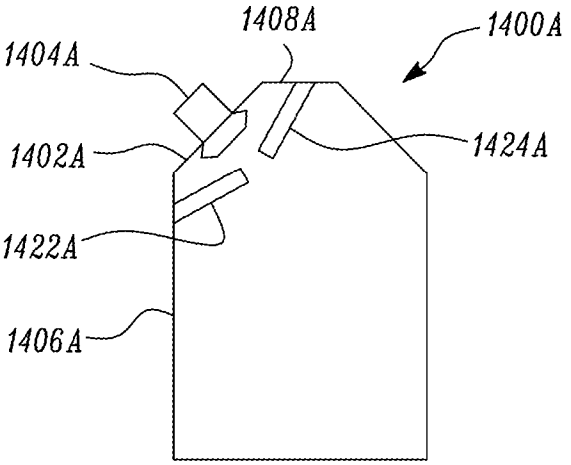
FIGS. 14A, 14B and 14C are schematic plan views of packages having different shapes.

FIG. 14A shows a package 1400A. Package 1400A includes a corner fitment arrangement including a fitment seal 1402A and a fitment 1404A. Further, fitment seal 1402A connects to a first adjacent seal 1406A and a second adjacent seal 1408A. Package 1400A further includes a first supplemental seal 1422A and a second supplemental seal 1424A. Package 1400A is substantially similar to package 100 of FIG. 1. However, package 1400A has a hexagonal shape with six edges having respective edge seals.

Figure 14C:
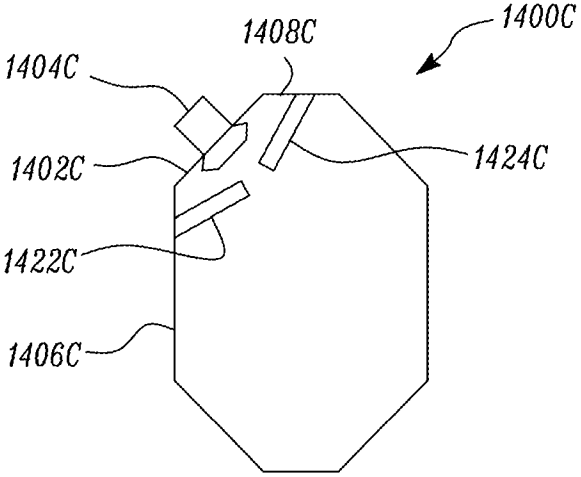
Figure 14B:
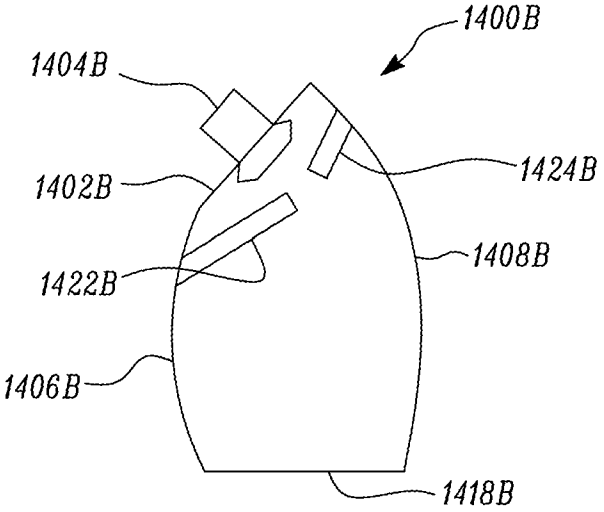

FIG. 14B shows a package 1400B. Package 1400B includes a corner fitment arrangement including a fitment seal 1402B and a fitment 1404B. Further, fitment seal 1402B connects to a first adjacent seal 1406B and a second adjacent seal 1408B. Package 1400B further includes a first supplemental seal 1422B and a second supplemental seal 1424B. Package 1400B is substantially similar to package 100 of FIG. 1. However, package 1400B has two curved edges. As shown in FIG. 14B, each of first adjacent seal 1406B and second adjacent seal 1408B is curved. Fitment seal 1402B is substantially straight and extends between first and second adjacent seals 1406B, 1408B. Fourth edge 1418B is substantially straight, and extends between first and second adjacent seals 1406B, 1408B.

FIG. 14C shows a package 1400C. Package 1400C includes a corner fitment arrangement including a fitment seal 1402C and a fitment 1404C. Further, fitment seal 1402C connects to a first adjacent seal 1406C and a second adjacent seal 1408C. Package 1400C further includes a first supplemental seal 1422C and a second supplemental seal 1424C. Package 1400C is substantially similar to package 100 of FIG. 1. However, package 1400C has an octagonal shape with eight edges having respective edge seals.

The packages described above may be made of a multilayer film. The multilayer film includes a sealing layer that forms a fitment seal, a first adjacent seal, a second adjacent seal, one or more first supplemental seals, one or more second supplemental seals, and one or more edge seals of a package. In regions where the multilayer film is sealed (e.g., by heat), this sealing layer is bonded to a suitable base material, such as a rigid or flexible package bottom, for example, including polypropylene or polyethylene. The base material may also be another multilayer film of the same type or of a different type. For example, if the multilayer film is folded upon itself and heat sealed at overlapping edges to provide a compartment bounded by non-sealed areas of the film, the multilayer film and base material, as well as the sealing layers being bonded, are necessarily the same. In regions where the multilayer film is not sealed, the sealing layer is the innermost layer, facing the interior of the package and often contacting the package contents, such as for example, a liquid detergent, directly.

A preferred sealing layer comprises (e.g., in a major amount of greater than 50% by weight) or consists essentially of (i) a polypropylene or (ii) a blend of polypropylene and at least one other polyolefin. Polyolefins include polyolefin plastomers, such as, for example polyethylene that may be blended in the sealing layer.

The thickness of the sealing layer is generally from about 10 μm (0.39 mils) to about 500 μm (20 mils), and typically from about 50 μm (2 mils) to about 200 μm (7.9 mils). In addition to the sealing layer, the multilayer film further includes an outer layer facing the exterior of the package and disposed furthest from the package contents. In the case of 2-layer films, the outer layer and sealing layer are adjacent and bonded directly to one another. In the case of films including further layers (i.e., 3 or more total layers), the outer and sealing layers are not adjacent, but separated by these further layers, being disposed therebetween. A representative outer layer includes (e.g., in a major amount of greater than 50% by weight), or consists essentially of, (i) biaxially oriented nylon, (ii) biaxially oriented polyethylene terephthalate, (iii) oriented polypropylene, or (iv) oriented polyethylene, among others. The thickness of the outer layer is generally from about 1 μm (0.039 mils) to about 100 μm (3.9 mils), and typically from about 7.5 μm (0.30 mils) to about 25 μm (0.98 mils).

In representative films including 3 or more layers, an adhesive layer or a primer layer may be disposed between the outer and sealant layers. In the particular case of a 3-layer film, the adhesive or primer may be adjacent to both the outer and sealant layers (i.e., sandwiched between these layers). Non-limiting suitable adhesives include 2-component polyurethanes that may have a solids content of about 60%, 50%, 40%, 30%, etc. Non-limiting suitable primers include aqueous resin dispersions having a solids content of about 5%.

In representative films including more than 3 layers, in addition to an adhesive or primer layer, such multilayer films may also include (i) one or more further biaxially oriented nylon or biaxially oriented polyethylene terephthalate layers, having a layer thickness as described above with respect to the outer layer, and/or (ii) one or more further adhesive or primer layers, as described above. Otherwise, such multilayer films may also comprise functional layers, including functional barrier layers such as aluminum foil. The thickness of a functional layer, when used, is generally from about 1 μm (0.039 mils) to about 100 μm (3.9 mils), and typically from about 5 μm (0.20 mils) to about 10 μm (0.39 mils).

The total thickness of a representative, multilayer film used in a package, as described herein, is generally from about 51 μm (2 mils) to about 380 μm (15 mils), and typically from about 74 μm (2.9 mils) to about 229 μm (9.0 mils).

A representative 5-layer film, for example, includes the following layers, in order: an outer layer of biaxially oriented polyethylene terephthalate, a polyurethane adhesive layer, a biaxially oriented nylon layer, a second polyurethane adhesive layer, and a polypropylene sealant layer. Another representative 5-layer film, for example, includes the following layers, in order: an outer layer of biaxially oriented polyethylene terephthalate, a polyurethane adhesive layer, an aluminum foil layer, a second polyurethane adhesive layer, and a polypropylene sealant layer.

EXAMPLES

Several packages in pouch configuration were made with the following laminated film: 48ga OPET/Ink/Adh/60ga BOPA/Adh/6.5 mil White LLDPE Coex. The pouch was a stand-up pouch of volumes indicated in Table 1. The pouch was similar to pouches depicted in FIGS. 1 and 3-7. Various supplemental seal designs were considered. The seal designs that were tested are shown in Table 1 below.

Control is a conventional corner fitment pouch. The control design has no supplemental seals. The corner fitment has an angle range of 115°-155°. The industry standard may be about 135°.

TABLE 1

Details for Test Subjects

| Volume of Package | Product Densities | Designs Tested |
|---|---|---|
| 1.4 liters | Liquids: 0.93-1 g/mL | Control<br>Full Parallel (FIG. 4)<br>Half-Angle (FIG. 5)<br>Triangle (FIG. 6)<br>Full Non-Parallel (FIG. 3) |
| 1 gallon | Liquids: 1-1.4 g/mL<br>Solids: 0.29-1.49 g/cm$^3$ | Control<br>Full Non-Parallel (FIG. 3) |

Drop tests were conducted using ISTA 3A with modifications as detailed below. These test parameters are provided below:

Drop height: 5 feet (1.52 meters)

Drop orientation sequence:

| | |
|---|---|
| 1. | Back |
| 2. | Front20 |
| 3. | Bottom |
| 4. | Back |
| 5. | Top |
| 6. | Front |
| 7. | Back 25 |
| 8. | Bottom |
| 9. | Back |
| 10. | Front |
| 11. | Top |
| 12. | Front |
| 13. | Bottom |
| 14. | Top |
| 15. | Back |

Success Criteria:

- Fail
  - A drop is considered a fail if the package leaks at the fitment or at the supplemental seals
  - Passed 5 or fewer drops
- Success
  - Complete: passed more than 10 drops
  - Partial: passed more than 5 drops
    - Partial success is considered passing because it has more durability compared to control Pass rate of the above designs are provided below in Table 2.

TABLE 2

Pass Rate of Designs

| Design | Number of Samples | Pass Rate | Mode of Failure |
|---|---|---|---|
| Control | 13 | 8% | Tear at fitment seal |
| Full Parallel | 47 | 85% | Tear at supplemental seals |
| Half-Angle | 100 | 66% | Tear at supplemental seal<br>Pinhole at fitment corner |
| Triangle | 18 | 83% | Tear at supplemental seal<br>Pinhole at fitment corner |
| Full Non-Parallel | 100 | 68% | Tear at supplemental seals |

It is apparent from Table 2 that the control had a low pass rate (8%) as compared to designs with one or more supplemental seals.

Each and every document cited in this present application, including any cross referenced, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The description, examples, embodiments, and drawings disclosed are illustrative only and should not be interpreted as limiting. The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Modifications and other embodiments will be apparent to a person of ordinary skill in the packaging arts, and all such modifications and other embodiments are intended and deemed to be within the scope of the present invention.

The invention claimed is:

1. A package comprising:

a fitment comprising a fitment centerline, a first base end and a second base end;

a fitment seal;

a first adjacent seal;

a second adjacent seal;

a fourth edge;

a first supplemental seal; and a second supplemental seal;

wherein the fitment seal connects to the first adjacent seal and the second adjacent seal; wherein the first adjacent seal comprises a first edge that connects to the fourth edge; wherein the second adjacent seal comprises a second edge comprising a position between the fitment seal and the fourth edge, wherein a portion of the second adjacent seal is parallel to and opposes the fourth edge;

wherein the fitment seal comprises a fitment seal angle between 90° and 180° from the first adjacent seal; wherein the fitment seal comprises the fitment; wherein a first foundation line extends from the first base end perpendicular to a line comprising the fourth edge; wherein an intermediate line extends from the fitment seal parallel to the first foundation line between the first base end and the first adjacent seal and is spaced from the first foundation line by 25 percent of a distance between the first adjacent seal and the first foundation line; wherein the first supplemental seal comprises a position anywhere from a bisection line comprising a line extending from the fitment centerline to the intermediate line; wherein a first base line extends from the first base end parallel to the bisection line wherein the first supplemental seal comprises a first point comprising a point closest to the first base line; wherein the second supplemental seal comprises a position anywhere from the bisection line to the second adjacent seal; wherein the second supplemental seal extends towards the second adjacent seal;

wherein a second base line extends from the second base end parallel to the bisection line; wherein the second supplemental seal comprises a second point comprising a point closest to the second base line; wherein the package comprises a single compartment comprising an innermost layer; wherein a region line extends through the first edge, the first point, the second point and the second edge and demarcates the package into a first region and a second region; wherein the first region comprises the fitment seal and the second region comprises the fourth edge; wherein the second region is a free-flow region allowing unobstructed movement of a product content that may be contained in the package between the innermost layer.

2. The package of claim 1, wherein the first supplemental seal comprises a position anywhere from 50 percent of a distance between the fitment seal and a line comprising the fourth edge from the fitment seal.

3. The package of claim 1, wherein the first supplemental seal extends towards the first adjacent seal and comprises a first angle from 90° and 180° as measured from the first adjacent seal to the bisection line and tangentially to the first point.

4. The package of claim 3, wherein the first supplemental seal extends to the first adjacent seal.

5. The package of claim 1, wherein a second foundation line extends from the second base end parallel to the fourth edge, wherein the second supplemental seal comprises a second angle from 90° to 180° as measured from the second adjacent seal to the bisection line and tangentially to the second point; wherein a first spacing comprises a distance between the fitment seal and the first point measured along a line parallel to the bisection line; wherein a second spacing comprises a distance between the fitment seal and the second point measured along a line parallel to the bisection line; and wherein the second spacing divided by the first spacing is less than 1.

6. The package of claim 1, wherein the fourth edge comprises a gusset.

7. The package of claim 1, wherein the second edge connects to the fitment seal and to the fourth edge.

8. The package of claim 1, further comprising a third edge connecting to the second edge and to the fourth edge.

* * * * *